US010655623B2

(12) United States Patent
Blume

(10) Patent No.: US 10,655,623 B2
(45) Date of Patent: May 19, 2020

(54) PUMP WITH SEGMENTED FLUID END HOUSING AND IN-LINE VALVE

(71) Applicant: George H Blume, Austin, TX (US)

(72) Inventor: George H Blume, Austin, TX (US)

( * ) Notice: Subject to any disclaimer, the term of this patent is extended or adjusted under 35 U.S.C. 154(b) by 360 days.

(21) Appl. No.: 15/732,441

(22) Filed: Nov. 13, 2017

(65) Prior Publication Data

US 2019/0145403 A1 May 16, 2019

(51) Int. Cl.

| | |
|---|---|
| ***F04B 53/10*** | (2006.01) |
| ***F04B 53/16*** | (2006.01) |
| ***F04B 1/122*** | (2020.01) |
| ***F04B 1/0538*** | (2020.01) |
| ***F04B 1/0448*** | (2020.01) |
| ***F04B 1/16*** | (2006.01) |
| ***F04B 1/0456*** | (2020.01) |
| ***F04B 1/145*** | (2020.01) |
| ***F04B 1/143*** | (2020.01) |
| ***F04B 1/0461*** | (2020.01) |
| ***F04B 1/053*** | (2020.01) |
| ***F04B 53/02*** | (2006.01) |

(52) U.S. Cl.

CPC ..... *F04B 53/1087* (2013.01); *F04B 1/0448* (2013.01); *F04B 1/0456* (2013.01); *F04B 1/0461* (2013.01); *F04B 1/053* (2013.01); *F04B 1/0538* (2013.01); *F04B 1/122* (2013.01); *F04B 1/143* (2013.01); *F04B 1/145* (2013.01); *F04B 53/02* (2013.01); *F04B 53/16* (2013.01); *F04B 53/164* (2013.01); *F04B 1/16* (2013.01)

(58) Field of Classification Search

CPC .... F04B 53/1087; F04B 53/02; F04B 53/164; F04B 53/16; F04B 53/1022; F04B 53/143; F04B 53/22; F04B 53/007; F04B 53/008; F04B 7/0266; F04B 1/0048; F04B 1/0538; F04B 1/053; F04B 1/0461; F04B 1/143; F04B 1/145; F04B 1/0456; F04B 1/122; F04B 1/16; F04B 1/0421

See application file for complete search history.

(56) References Cited

U.S. PATENT DOCUMENTS 4,716,924 A * 1/1988 Pacht ..... F04B 49/10 137/327
2017/0082103 A1* 3/2017 Morreale ..... F04B 53/1032

* cited by examiner

*Primary Examiner* — Charles G Freay
*Assistant Examiner* — Christopher J Brunjes
(74) *Attorney, Agent, or Firm* — Gary W. Hamilton

(57) ABSTRACT

A plunger pump fluid end assembly design in which the suction valve and seat is aligned with the plunger and the fluid end housing is constructed with multiple modules. Modules are held in a rigid assembly by staybolts that connect to the power end of the plunger pump. Said staybolts pass though bores in the central fluid module and the suction seat module and bound by a conventional threaded nut. Packing box modules are bound to the central fluid module by bolts that also pass through separate bores in the same central module. A suction valve spring retainer/plunger spacer within the plunger bore of the assembly shields the intersection of the plunger bore and the discharge bore from destructive erosion damage.

7 Claims, 25 Drawing Sheets

Section "B-B" of Figure 3A

Section "A-A" of Figure 6A

Prior Art

USPTO Application Number: 15/330,213

Section "B-B" of Figure 12A

Section "C-C" of Figure 12A

Section "D-D" of Figure 13C

Section "B-B" of Figure 15A

Section "C-C" of Figure 15A

Section "D-D" of Figure 16C

PUMP WITH SEGMENTED FLUID END HOUSING AND IN-LINE VALVE

PRIORITY DATA

This patent application claims priority to U.S. Non-Provisional patent application Ser. No. 15/330,213, filed on Aug. 23, 2016, and also claims priority to U.S. Non-Provisional patent application Ser. No. 15/330,212, filed on Aug. 23, 2016. Each of the aforementioned provisional patent applications, by this reference, are incorporated herein for all purposes.

FIELD OF THE INVENTION

The invention relates generally to high-pressure plunger pumps used, for example, in oil field operations. More particularly, the invention relates to a modular fluid end design with an internal bore configuration that improves flow, improves fluid end filling, and incorporates structural features for stress-relief in high-pressure plunger pumps.

BACKGROUND

Engineers typically design high-pressure oil field plunger pumps in two sections: the (proximal) power section and the (distal) fluid section. The power section usually comprises a crankshaft, reduction gears, bearings, connecting rods, crossheads, crosshead extension rods, etc. Power and fluid sections are commonly referred to in the industry, and hereafter in the application, as the power end and fluid end, respectively. Fluid ends usually comprise a plunger pump fluid end housing with multiple internal cavities or fluid chambers, each chamber having a suction valve in a suction bore, a discharge valve in a discharge bore, and a plunger in a plunger bore, plus high-pressure seals, retainers, etc. FIG. 1 is a cross-sectional schematic view of a typical fluid end housing showing its connection to a power end by stay rods. A plurality of fluid chambers similar to that illustrated in FIG. 1 may be combined, as suggested in the Triplex fluid end housing comprising three (3) fluid chambers is schematically illustrated in FIG. 2. A pump with five (5) fluid chambers or 5 plungers is referred to as a quintuplex pump.

Valve terminology varies according to the industry, e.g., pipeline or oil field service, in which the valve is used. In some applications, the term "valve" means just the moving element or valve body. In the present application, however, the term "valve" includes other components in addition to the valve body, e.g., various valve guides to control the motion of the valve body, the valve seat, and/or one or more valve springs that tend to hold the valve closed, with the valve body reversibly sealed against the valve seat.

Valve and seat sizing design is a compromise between competing objectives in fluid end design. Traditionally engineers have wanted to use suction valve and seat designs of as a large a size as possible, as the larger the flow area in the valve and seat, the lesser the flow restriction. Flow restrictions reduce fluid energy which hinders the complete filling of the fluid chamber and the volumetric efficiency of the pump. Incomplete filling of the fluid chamber can cause a rough running pump. Additionally, larger valve and seat sizes reduce fluid velocity through the valve and seats. High fluid velocity contributes to erosion damage of the valve seal and leads to premature seal failure of the valve. For additional detail on valve erosion damage read the teaching of U.S. Pat. No. 9,416,887. The disadvantage of larger valve and seat sizes is the greater the size and weight of the fluid end housing necessary to contain the larger size valve and seat. Larger valve and seat sizes also result in higher valve loads and higher stresses on the fluid end housing which can result in premature structural failure of the housing. In rare instances in the prior art, suction valves and seats were slightly larger than discharge valves and seats. The theoretical reason for this sizing was based on the belief that greater flow area was necessary in the suction valves and seats to reduce flow restrictions than comprised fluid energy in filling the fluid chamber on the suction stroke. Further, many designers observed that the fluid in the discharge stroke inherited great fluid energy from the applied power of the moving plunger and thus smaller valve and seat sizing could be applied to the discharge valves and seats. This reasoning ignores the requirement to reduce fluid velocity in both sets of valves and seats to prevent erosion damage and premature failure to valve seals.

Similarly in the prior art, the suction port and discharge were almost always maximized to reduce flow restrictions. The suction port and discharge port are the volumetric bores directly upstream and feeding the suction valve/seat and discharge valve/seat, respectively. The respective bore of these respective ports would typically be maximized by boring the port to the small diameter of the taper in the fluid end housing utilized in capturing and securing the suction or discharge seat. This design practice was justified in the suction port because of the need to preserve fluid energy by reducing flow restrictions. By default, the same practice was utilized for the discharge port. As will be discussed later in this application, a large discharge port is not warranted.

Each individual bore in a plunger pump fluid end housing is subject to fatigue due to alternating high and low pressures which occur with each stroke of the plunger cycle. Conventional fluid end housings, also referred to as Cross-Bore blocks, typically fail due to fatigue cracks in one of the areas defined by the intersecting suction, plunger, access and discharge bores as schematically illustrated in FIGS. 3A and 3B.

To reduce the likelihood of fatigue cracking in the high-pressure plunger pump fluid end housings described above, a Y-block housing design has been proposed. The Y-block housing design, which is schematically illustrated in FIG. 4A, reduces stress concentrations in a plunger pump housing, such as that shown in FIG. 3A, by increasing the angles of bore intersections above 90°. In the illustrated example of FIG. 4A, the bore intersection angles are approximately 120°. A more complete cross-sectional view of a Y-block plunger pump fluid end housing and the assembly components is schematically illustrated in FIG. 4B.

Both cross-bore blocks and Y-blocks have several major disadvantages when used to pump heavy slurry fluids as typically utilized in oilfield fracturing service. A first disadvantage is related to the feeding of the fluid chamber on the suction stroke of the pump. Upon passing through the suction valve, the fluid must make a 90 degree turn in a cross-bore housing, or a 60 degree turn in a Y-block housing, into the plunger bore as illustrated in FIG. 5. This change in the direction of the heavy fluid robs the fluid of kinetic energy, hereafter referred to as fluid energy.

Fluid energy is normally added to the fluid by small supercharging pumps upstream from the plunger pump. Fluid energy is necessary to overcome fluid inertia and ensure complete filling of the fluid chamber on the suction stroke. If the fluid could enter the fluid chamber in a linear or straight path, less fluid energy would be lost.

The second disadvantage of Cross-Bore blocks and Y-blocks relates to the large intersecting curved areas where the various bores intersect. Because the suction bore above the suction valve is almost as large as the plunger bore, the intersection area of the suction bore with the plunger bore is particularly large, as illustrated in FIGS. 3A and 3B. While the intersection of the suction bore and the plunger bore is especially large, the intersection of the discharge bore and the plunger bore is almost as large.

As shown in FIGS. 6A and 6B, the intersecting cylindrical sections result in intersection curves that focus or concentrate the stresses generated by the internal pump pressures into a very small area. This small area is located at the bore intersection near the plane formed by the centerline axis of the plunger and suction or discharge bore cylinders at the finite point of the intersection of the two cylinders. Because the intersection curve changes slope through three-dimensional space, this intersection cannot be easily chamfered or filleted by conventional machining techniques that would mitigate these stresses. Indeed, complex computer finite element stress analysis calculations indicate that chamfering or filleting the corner intersection has minimal effect on reducing the stresses at this corner intersection.

The amount of stress at the intersecting bores of conventional fluid end housings is defined by the magnitude of the "Bore Intersection Pitch" as illustrated in FIGS. 3A, 3B, and 4A. Any geometry that reduces the "Bore Intersection Pitch" will reduce the stress concentrations in the fluid end and increase the life of the fluid end by mitigating cyclic fatigue failure. Y-Block fluid end housing designs, such as those illustrated in FIG. 4A, do reduce this pitch, but the reduction is insufficient to prevent cyclic fatigue failure of the fluid end housing when subjected to high pressure and long pumping cycles.

Previously filed U.S. Non-Provisional patent application Ser. No. 15/330,212, filed on Aug. 23, 2016, and U.S. Non-Provisional patent application Ser. No. 15/330,213, filed on Aug. 23, 2016, featured an "in-line" design and addressed many of the issues of failure due to high stress and "Bore Intersection Pitch." These applications also addressed the loss of fluid energy at the intersection of the suction bore and plunger bore in typical cross bore designs illustrated in FIGS. 1, 2, 3A, 3B, 4A, 4B, and 5 of those patent applications.

One of the major shortcomings of the U.S. application Ser. Nos. 15/330,212 and 15/330,213 relates to maintenance complications encountered when changing the plunger or plunger packing. Fluid ends built to Ser. Nos. 15/330,212 and 15/330,213 require removal of the entire fluid end assembly to access the damaged or worn parts. This problem could be addressed with a two-piece plunger design; however, such plungers are difficult to access for maintenance and are prone to premature failure. A design similar to that disclosed in prior art application Ser. No. 15/330,212, with a modification to allow access for maintenance to plungers, packing, suction valve, and the suction seat would provide a major and much needed improvement.

SUMMARY OF THE INVENTION

In accordance with embodiments of the invention, a fluid end assembly with a modular fluid end housing design is disclosed. The fluid end assembly comprises a modular housing, suction manifold and multiple plungers, suction and discharge valves and seats, suction valve spring retainer/plunger spacers, staybolts, various seals, and miscellaneous components.

A modular housing of the present invention comprises a single central fluid module and multiple suction seat modules and packing box modules. The central fluid module has multiple internal cavities or fluid chambers. The modular housing assembly includes an equal number of suction seat modules and packing box modules. The number of fluid chambers equals the number of plungers in the pump. The central fluid module is bound to the power end and the suction seat modules by stayrods that pass through stayrod bores in the central fluid module. The packing boxes modules are bound and secured to the central fluid module by packing box bolts that pass through packing box bolt bores in the central module. In the prior art, packing box modules were bound to the fluid end by bolts that were threaded into the main module of the fluid end. The threads in the fluid end housing necessary to accommodate the threaded bolts resulted in high stresses in the sharp cornered thread roots. These high stresses combined with stresses at the intersection of the discharge and suction valve bores with the plunger bore resulted in cyclic fatigue and structural failure of the fluid end.

The modular design of the present invention affords several unique advantages. For example, the present disclosure provides vastly improved access for maintenance, thereby augmenting the improvements disclosed in the fluid end of U.S. Non-Provisional patent application Ser. No. 15/330,213, illustrated in FIG. 7. The plunger, packing, suction valve and seat of the present invention can easily be accessed for maintenance and repair by removing the suction seat module from the modular housing. Second, individual modules can be easily be removed and replaced should the particular module fail. In addition to structural failure due to high stress, packing box failures due to erosion from the failure of the packing seal are a common problem; replacing the packing box module is for significantly less costly than replacing the entire fluid end assembly. Third, the modular design is less expensive to manufacture than traditional fluid end housing typical of FIGS. 1-7 because the individual modules of this invention can be machined on smaller manufacturing machines than the much larger machines required for the manufacture of traditional fluid end housing typical of FIGS. 1-7.

In the various embodiments of the invention, staybolt and plunger box bolt bores pass uninterrupted through the central fluid module; threads are eliminated in central fluid modules. Because of the lack of stress in the thread roots typical of packing box attachment designs of the prior art overall stress in the central fluid module is reduced and this member can be reduced in size. This size reduction results in lower manufacturing cost and lower fluid end assembly weight. The latter is critical in truck mounted pumps typical of the high pressure fracturing industry.

The central fluid module of the present invention comprises multiple fluid chambers with each chamber having a plunger bore and a discharge bore. The centerline of the plunger bore is collinear or aligned with the centerline of the suction bore of the suction seat module, commonly referred to as an "in-line configuration," i.e., the bores and centerlines are aligned. The configuration of the suction bore of the present invention eliminates the loss of fluid energy present in fluid end housings of the prior art in which the suction fluid flow must undergo a right-angle turn to fill the fluid chamber of the housing. Inherently the packing box bore centerline is collinear with the centerline of the plunger bore centerline. The discharge port of the discharge bore in the fluid chamber of the central fluid module is required by this design to pass between two of each of the stayrod and packing box bolt bores without piercing said stayrod or packing box bolt bores. In order to contain the high pump pressure within the discharge port, the discharge port must be surrounded by sufficient wall thickness within the central fluid module to prevent structural failure of discharge port due to the high pressure contained within.

As discussed in the background of this application, a significantly large discharge and suction valve and seat are necessary to prevent erosion damage to the valve seal when pumping abrasive slurries at high volumes or pump rates. However, a large discharge valve and seat requires a large discharge port in the prior art. Notably, the prior art fails to discuss the size of the discharge port that connects the discharge valve and seat with the plunger bore in the fluid chamber of the fluid end. Because flow in the discharge port is straight and uniform without obstructions or changes of direction, the flow area of the discharge port can be significantly reduced as compared to the flow area of either the discharge or suction valve and seat. Accordingly, the flow area of the discharge port can also be reduced compared to the flow area immediately below either the discharge or suction valves and seats. The prior art fails to disclose the relationship between the discharge port and the discharge manifold. The discharge manifold must accommodate the flow of at least two (2) plungers in a triplex pumps or three (3) plungers in a quintuplex pump. Because of the staggered throws on the crankshaft, multiple discharge and suction valves and seats are open at a particular moment in the revolution or cycle of the pump crankshaft. Thus the discharge manifold must accommodate the exhaust of multiple plungers at a particular moment in time. Thus the size of the discharge port need not be any larger than 50% of the size of the discharge manifold because both the discharge port and manifold are subjected to the same flow conditions. Sizing of the discharge port based on this derivation results in a discharge port of a size significantly smaller is size of any in the prior art. In the prior art discharge ports were by default simply designed to the same size as the bottom of the taper in the fluid end housing utilized to capture the discharge seat. In the prior art, there is no disclosure of reducing the size of the discharge port to reduce stress at the intersection of the discharge and plunger bores of the fluid end housing.

In the present invention, the flow in the discharge port transitions to the larger flow area in the discharge seat via a frusto-concial volume located between the bottom of the discharge seat and the discharge port. This transitional volume reduces the flow rate of the slurry as it enters the discharge valve and seat. The disclosure of the present invention teaches a nonobvious advantage by showing that the width of the discharge port can be significantly reduced. This width is measured perpendicular to a plane formed by the centerline axis of the plunger bore and discharge bore. Reducing the width of the discharge bore, as defined above, also reduces the Bore Intersection Pitch, which also reduces the stress at the intersection of the plunger bore and the discharge port. Reducing the width of the discharge port, as defined above, allows the discharge port to pass undisturbed between the stayrod bores and plunger box bolt bores without piercing said bores and compromising the structural strength of the central fluid module.

In an alternate embodiment of this invention, the discharge port is oblong in cross section as opposed to circular. In this embodiment the width of the discharge port is unchanged from the first embodiment in which the discharge port is cylindrical; this width is measured perpendicular to a plane formed by the centerline axis of the plunger and discharge bores. This embodiment does not change the Bore Intersection Pitch or increase the stress level at the intersection of the plunger bore and the discharge port.

There is the potential of turbulence and erosion damage by a highly abrasive fracturing fluid laden with sand as the fluid is pushed out of the plunger bore into the discharge port, through the discharge valve and seat, and into the discharge manifold. Both embodiments utilize a suction valve spring retainer/plunger spacer with a sleeve or tubular section with a single port to exhaust pumped fluid from the plunger bore into the discharge port. A key feature of this invention is the sizing of the port in this sleeve section. The port is sized is be equal to or slight smaller in area than the area at the intersection of the discharge port with the plunger bore in the fluid chamber of the central fluid module. With the proper positioning, alignment, and sizing of the port in the suction valve spring retainer/plunger spacer, this member becomes a sacrificial, inexpensive, and replaceable part that can be used to absorb erosion damage and prevent premature failure of the central fluid module by structural failure due to high stress induced from the erosion damage.

DETAILED DESCRIPTION OF PREFERRED EMBODIMENTS

Figure 1:
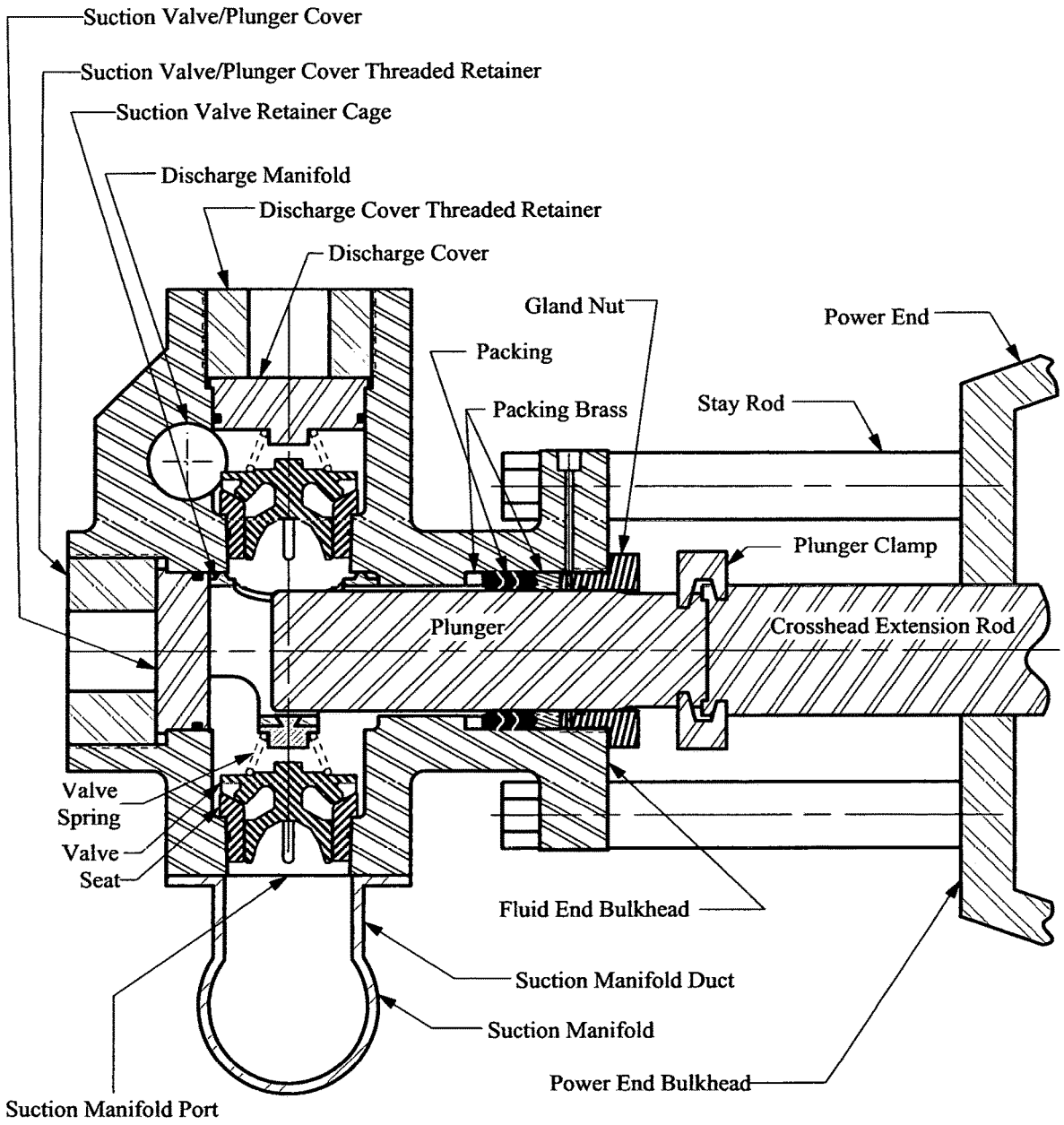
Prior Art Figure 1
FIG. 1 is a cross-sectional schematic view of a typical prior art plunger pump fluid end showing its connection to a power end by stay rods.
Figure 2:
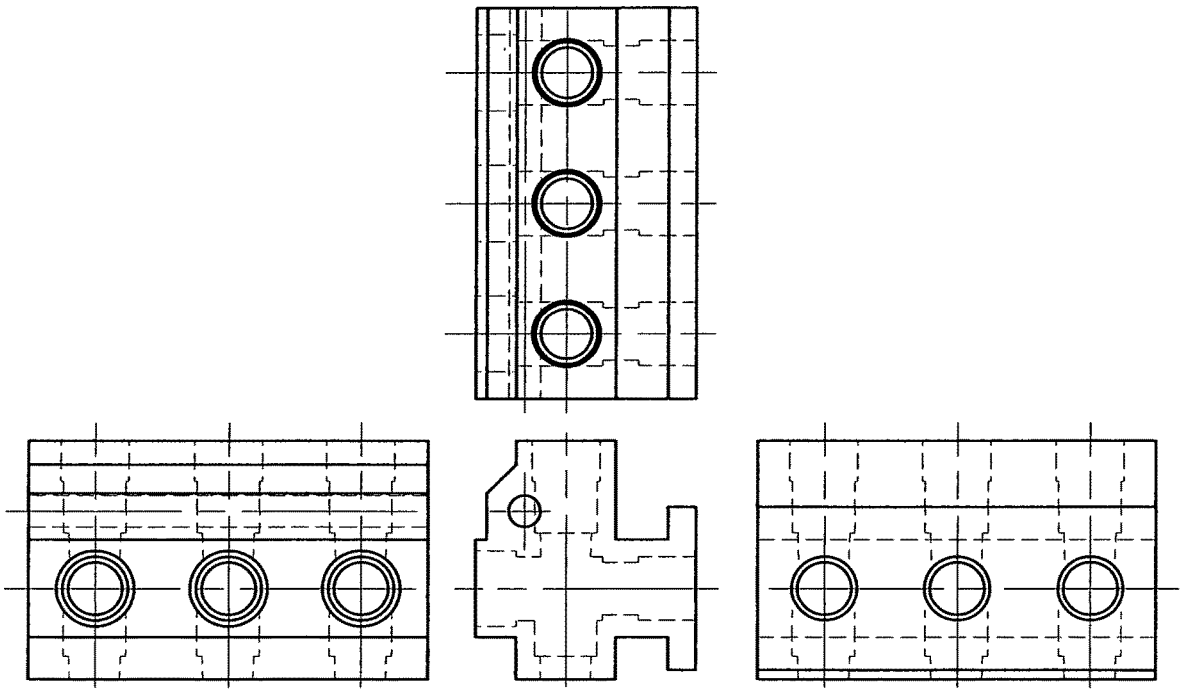
Prior Art Figure 2
FIG. 2 schematically illustrates a conventional prior art Triplex plunger pump fluid end housing.
Figure 8:
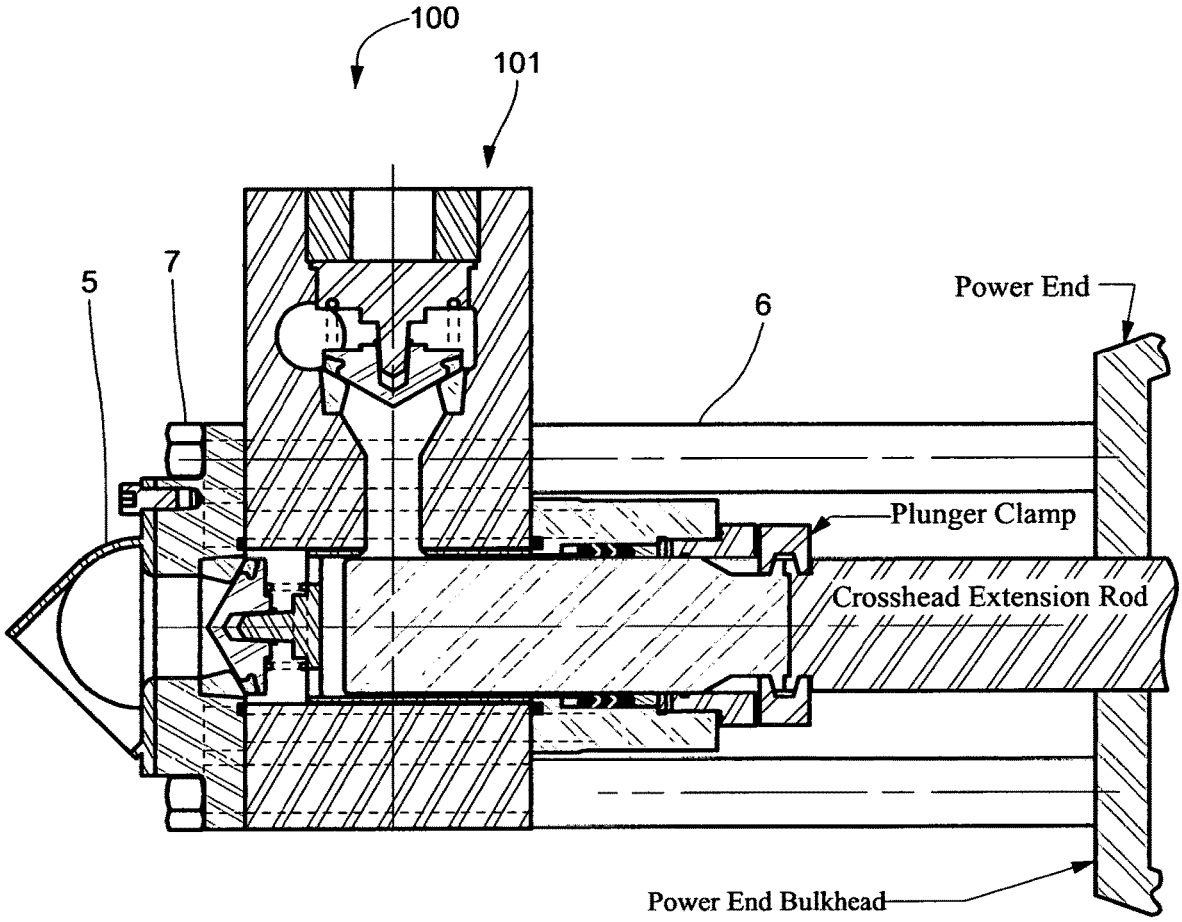
FIG. 8 schematically illustrates a cross-section of the fluid end assembly of the present invention showing its connection to a power end by stay rods.

FIG. 8 schematically illustrates a cross-section of an embodiment of the fluid end assembly 100 of the present invention showing its connection to a power end by multiple stay rods 6. As opposed to the fluid end housing of the prior art as illustrated in FIG. 1, fluid end assembly 100 of the present invention is configured with the suction manifold 5 mounted in a position on the fluid end housing opposite the power end of the pump. The primary component of the fluid end assembly 100 of the present invention is modular housing 101 which is connected to the power end by multiple stayrods 6 and stayrod retaining nuts 7.

Figure 9:
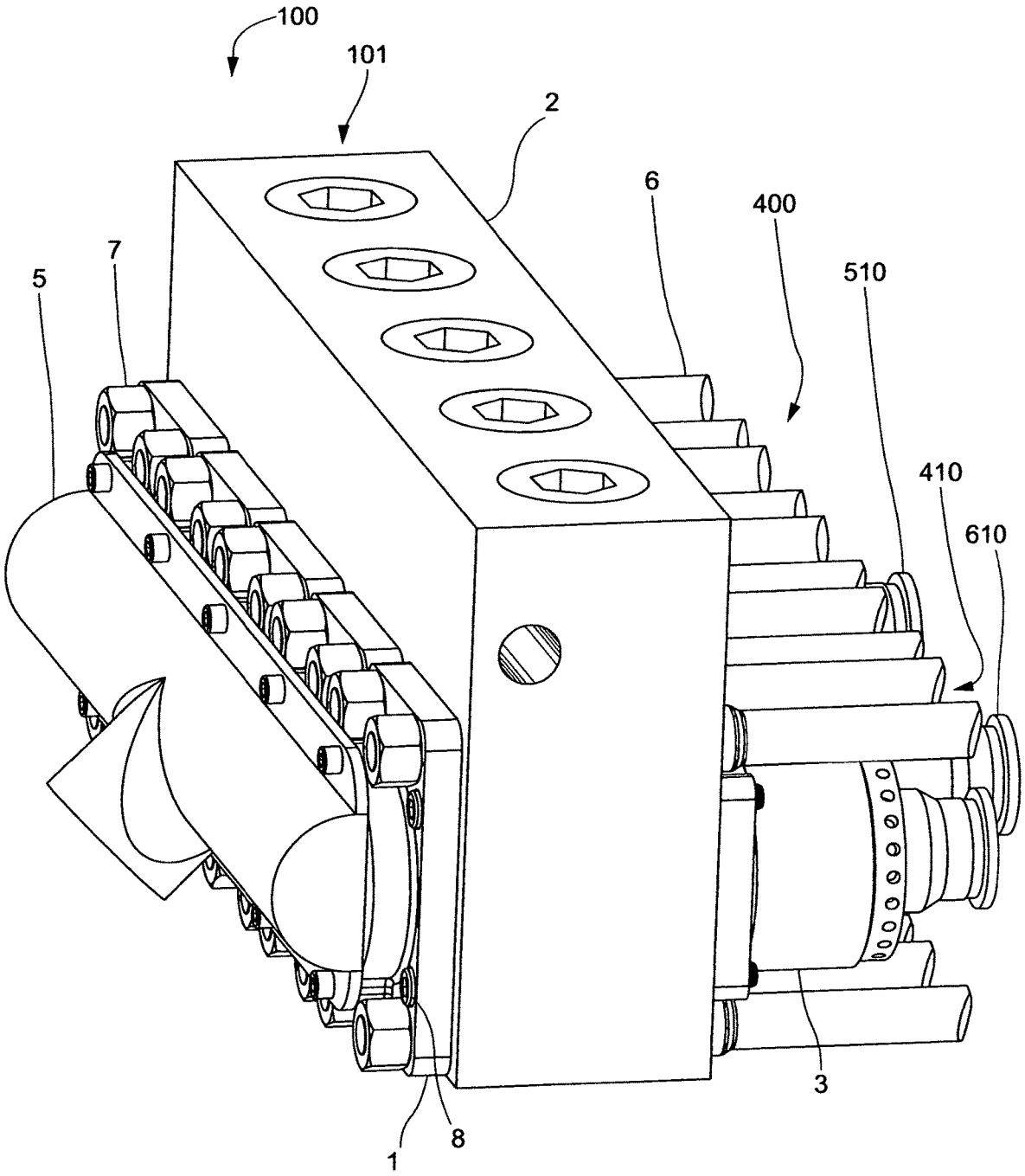
FIG. 9 illustrates an orthogonal exterior view of the fluid end assembly of the present invention.
Figure 10A:
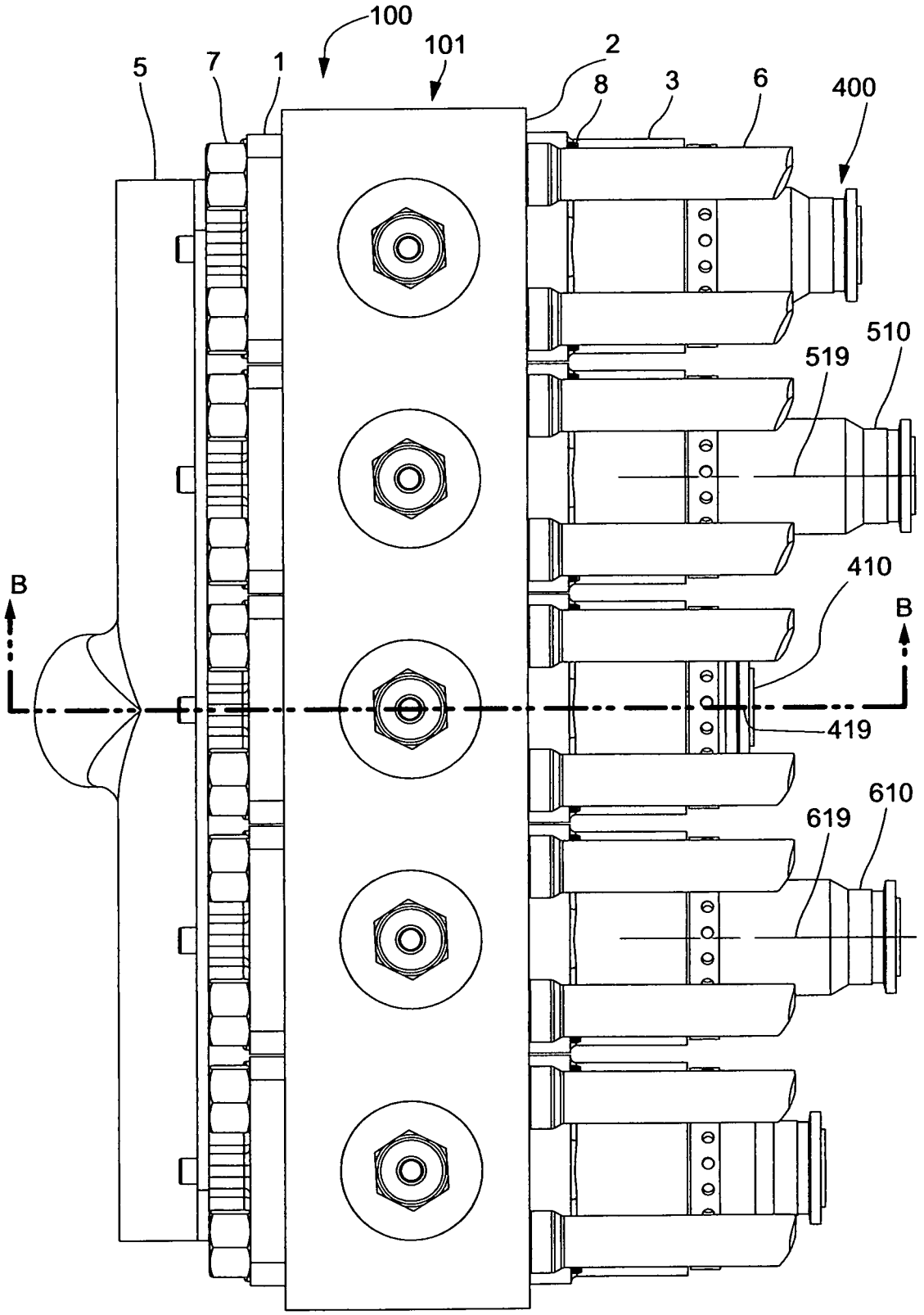
FIG. 10A illustrates a top external view of the fluid end assembly of the present invention.

FIG. 9 and FIG. 10A schematically illustrates an orthogonal and top view respectively of the exterior of the fluid end assembly 100. Fluid end assembly 100 comprises modular housing 101, suction manifold 5, and various internal components. The modular housing 101 includes one central fluid module 2 and multiple packing box modules 3, suction seat modules 1, stayrods 6, stayrod retaining nuts 7, packing box module retaining bolts 8, and internal seals 9 (illustrated in FIG. 10B.) The number of packing box modules 3 and the number of suction seat modules 1 correspond to the number of plungers 400 in the fluid end assembly 100. The fluid end assembly 100 illustrated in FIG. 9 is constructed with five (5) plungers 400 including the center most plunger 410 and immediately adjacent plungers 510 and 610 located to either side. Plungers 410, 510, and 610 are defined by plunger centerlines 419, 519, and 619, respectively, as illustrated in FIG. 10A. Modular housing 101 is attached to the pump power end by multiple stayrods 6. Stayrods 6 with the aid of the stayrod retaining nuts 7 bind and secure the suction seat modules 1 to the central fluid module 2. Typically there are four (4) stayrods 6 per plunger 400 in the fluid end assembly 100. Packing box module retaining bolts 8 bind and secure the plunger boxes 3 to the central fluid module 2. Typically there are four (4) packing box module retaining bolts 8 per plunger box module 3 in the modular housing 101.

Figure 10B:
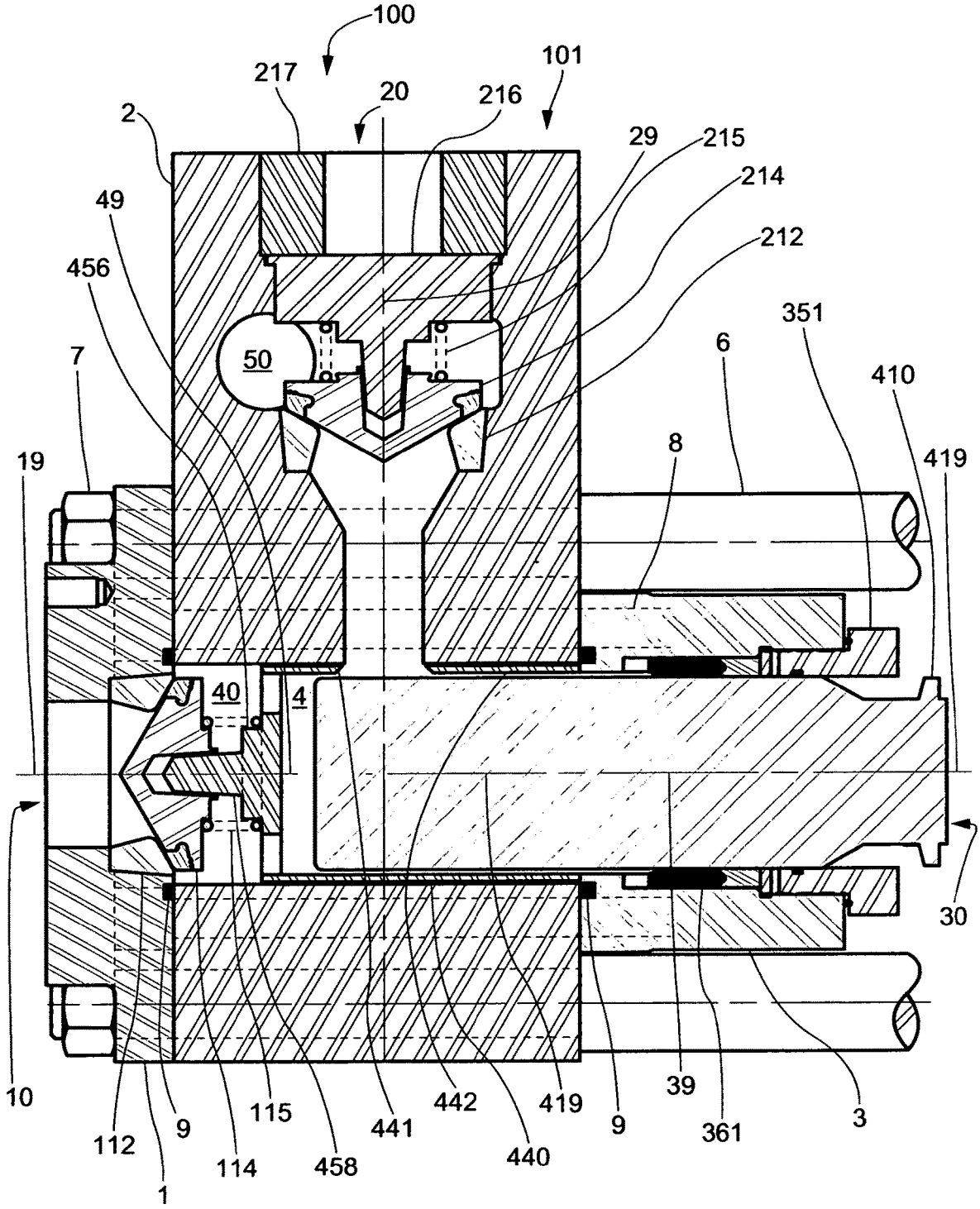
FIG. 10B schematically illustrates the sectional view labeled B-B in FIG. 10A including detailed cross sections of the components of the assembly.

FIG. 10B schematically illustrates a cross-section of the fluid end assembly 100 of the present invention showing modular housing 101 and the major internal components of the assembly 100. Modular housing 101 includes central fluid module 2, suction seat module 1, packing box module 3, stayrods 6, stayrod hex nuts 7, packing box module retaining bolts 8, and seals 9. Modular housing components comprises multiple internal bores 10, 20, 30 and 40. Central fluid module 2 comprises multiple fluid chambers 4, with one fluid chamber 4 for each plunger 400 in the pump. Each fluid chamber 4 consists of a discharge bore 20 and a plunger bore 40. Suction bore 10 with centerline 19 is wholly located within the suction seat module 1. Plunger packing bore 30 with centerline 39 is wholly located within packing box module 3. The centerlines 39 and 19 of the packing bore 30 and the suction seat module bore 10 respectively are substantially collinear with the centerline 49 of the plunger bore 40. The centerline 29 of the discharge bore 20 is substantially perpendicular to a plane formed by the centerlines 419, 519, and 619 of plungers 410, 510, and 610 respectively. Plunger centerline 419 is substantially collinear with plunger bore centerline 49.

The suction bore 10, located wholly within the suction seat module 1 and opposite to the packing bore 30, holds the suction seat 112. Discharge bore 20 connects with discharge manifold 50, which connects with multiple adjacent discharge bores and exhausts pumped fluid externally from the modular housing 101. Discharge bore 20 contains a discharge seat 212, discharge valve 214, discharge valve spring 215, discharge cover 216, and discharge cover retainer 217. Major internal components of the assembly 100 arranged in the packing bore 30 of packing box module 3 include plunger packing 361, and the plunger packing gland nut 351. Plunger bore 40 holds the suction valve spring retainer/plunger spacer 440, suction valve 114, suction valve spring 115, suction valve guide 458 and suction valve spring retainer 456. Suction valve guide 458 and suction valve spring retainer 456 are integral to the suction valve spring retainer/plunger spacer 440. Plunger 410 reciprocates back and forth within the sleeve section 442 of the suction valve spring retainer/plunger spacer 440, packing box module bore 30, packing 361, and packing gland nut 351.

Figure 11:
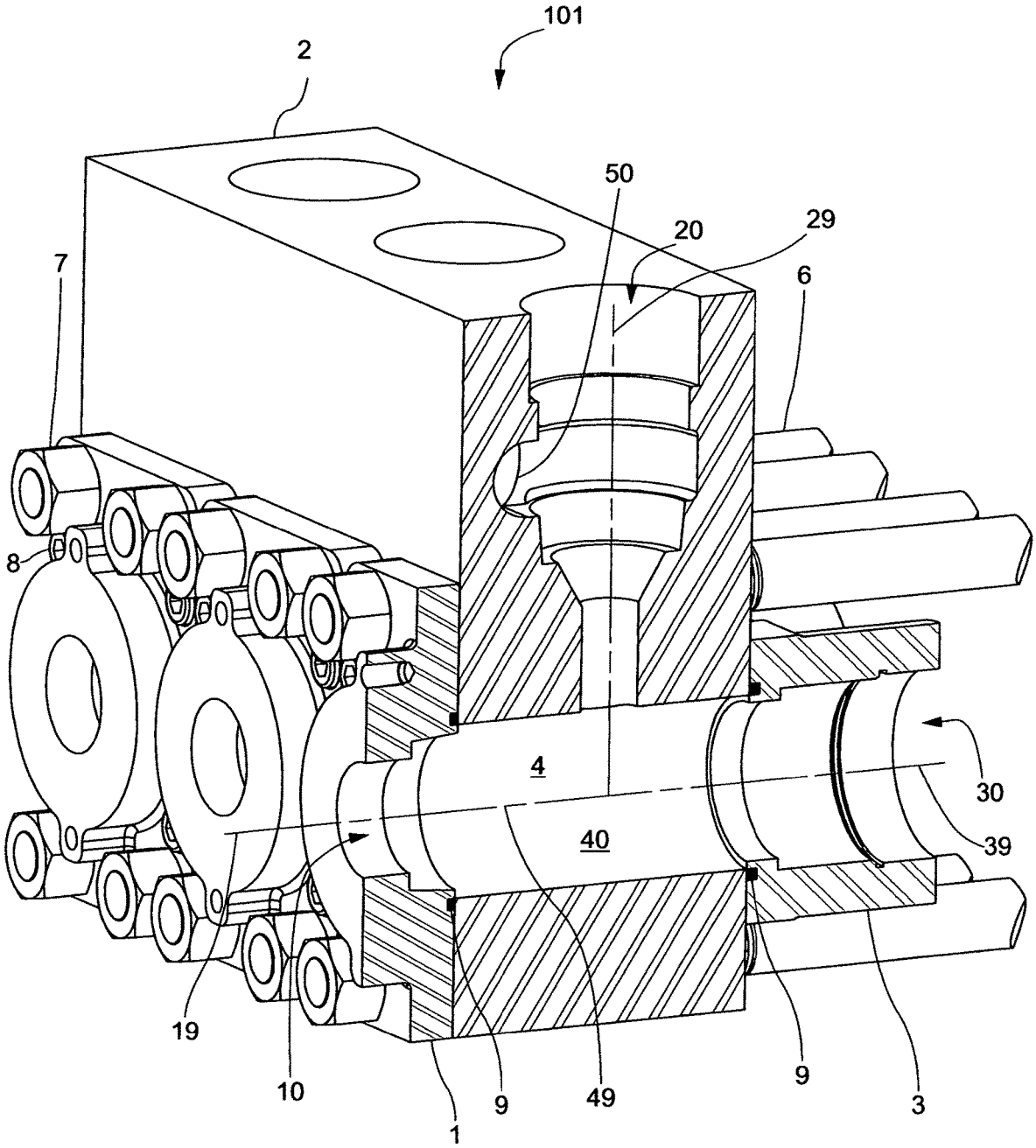
FIG. 11 illustrates an orthogonal cross sectional view of the modular housing of the present invention; excluding interior components of the fluid end assembly.

FIG. 11 is an orthogonal cross sectional view the modular housing 101 of FIG. 9 where the cross section plane is defined by the plunger bore centerline 49 and the discharge bore centerline 29.

Figure 12A:
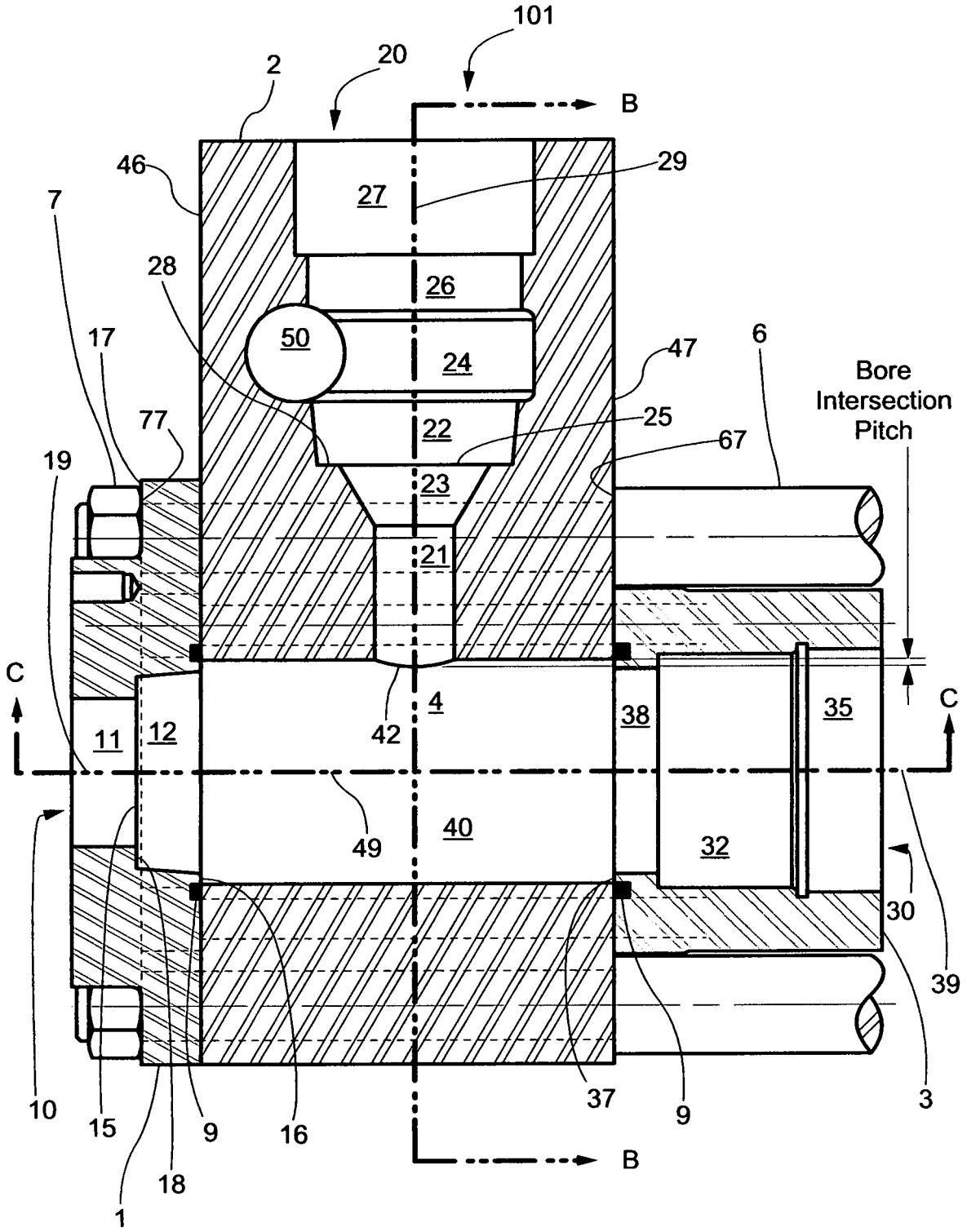
FIG. 12A schematically illustrates cross section of the fluid end housing of the present invention.

FIG. 12A is an illustrated planar view of the cross section of FIG. 11 featuring the modular housing 101 comprising the suction bore 10, discharge bore 20, packing bore 30, plunger bore 40, and discharge manifold bore 50. Various internal components of the modular housing 100 shown in FIGS. 8 and 10B are not illustrated in FIGS. 11, 12A, 12B, and 12C. Suction bore 10 as illustrated in FIG. 12A comprises a tapered suction seat bore 12 that captures suction seat 112. Immediately adjacent to the suction seat area 12 is suction port 11 that connects the suction seat 112 and suction valve 114 with the suction manifold 5 as illustrated in FIGS. 8 and 9. Tapered suction seat bore 12 is separated from suction port 11 by suction seat taper shoulder 18 to which the bottom of suction seat 112 contacts. Internal diameter 15 of suction seat taper shoulder 18 is coincidental with internal diameter 15 of suction port 11.

Discharge bore 20 of the central fluid module 2 comprises a tapered discharge seat bore 22 that captures the discharge seat 212 as shown in FIG. 10B. Immediately adjacent to the tapered discharge seat bore 22 is frusto-conical transition volume 23 and discharge port 21 that connect the discharge seat 212 and discharge valve 214 with plunger bore 40 at the bore intersection 42. Discharge bore 20 of central fluid module 2 also contains a discharge cover bore 26 and discharge cover retainer bore 27 that mate with discharge cover 216 and discharge cover retainer 217, respectively. Discharge valve bore 24 allows fluid passage from discharge seat 212 around discharge valve 214 and into discharge manifold 50.

Tapered discharge seat bore 22 is separated from frusto-conical transition volume 23 by discharge seat taper shoulder 28 to which the bottom of discharge seat 212 contacts. Internal diameter 25 of suction seat taper shoulder 28 is coincidental with major internal diameter 25 of frusto-conical transition volume 23.

Packing box module bore 30 comprises a packing bore 32 for holding plunger packing 361 and a plunger packing gland nut bore 35 for positioning of the plunger packing gland nut 351, as illustrated in FIG. 10B. Packing bore 32 is separated from the plunger bore 40 by a transition bore 38 which connects the packing box module bore 30 with plunger bore 40. Centerlines 39, 19, and 49 of packing bore 30, suction bore 10, and plunger bore 40 respectively are substantially collinear.

Each fluid chamber 4 of central fluid module 2 consists of a discharge bore 20 and a plunger bore 40. Plunger bore 40 mates concentrically with suction valve spring retainer/plunger spacer 440. As illustrated in FIG. 10B, spacer port 441, located within sleeve section 442 of suction valve spring retainer/plunger spacer 440, connects plunger bore 40 with discharge port 21. Multiple seals 9 close and seal internal pump pressure within each fluid chamber 4 from the exterior of modular housing 101. Substantially identical seals 9 seal between central fluid module 2 and multiple suction seat modules 1 and again between central fluid module 2 and multiple packing box modules 3.

Figure 12B:
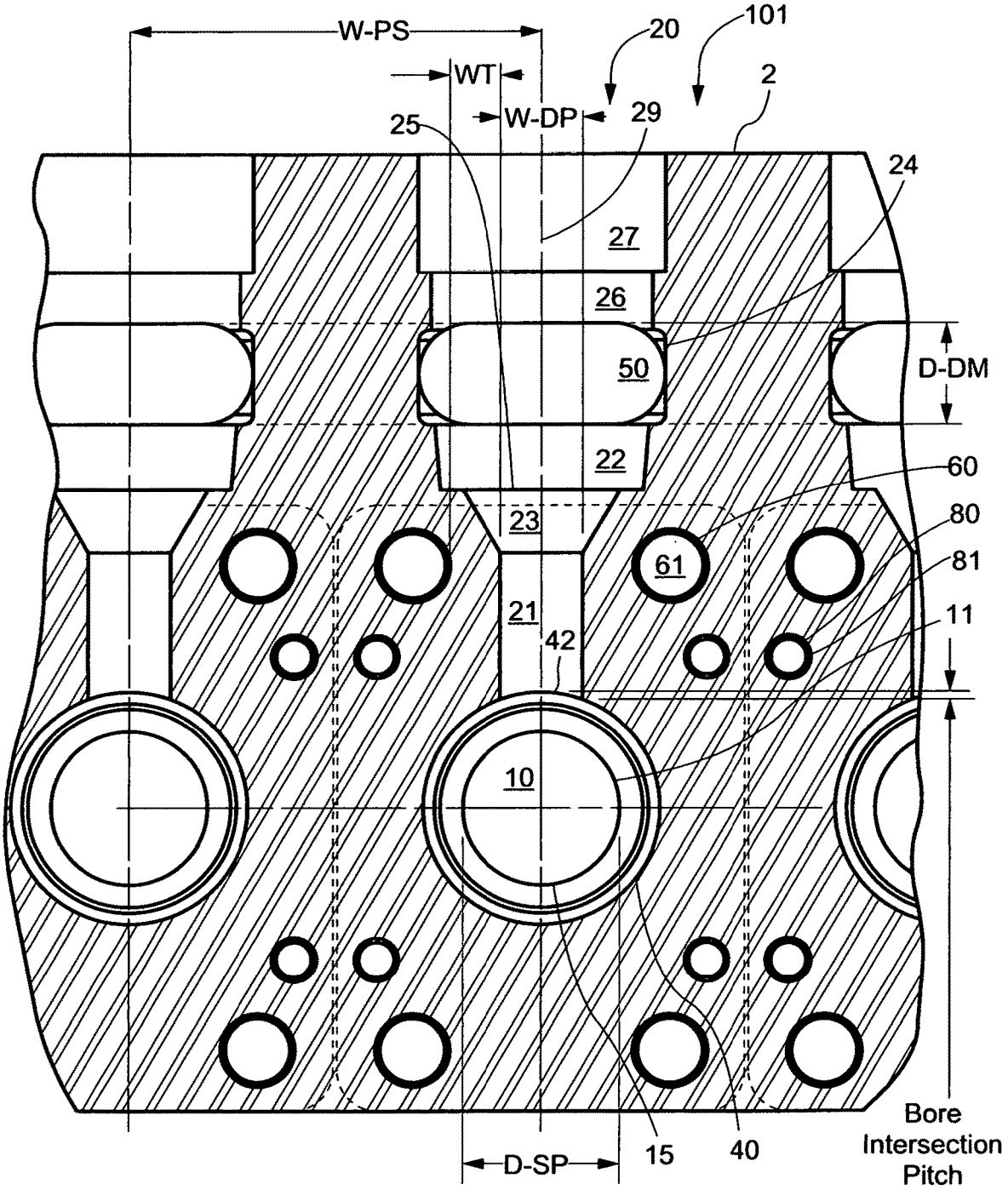
FIG. 12B schematically illustrates the sectional view labeled B-B in FIG. 12A.

As further illustrated in FIGS. 11 and 12A, stayrod 6 connects central fluid module 2 with multiple seat carriers 1. As illustrated in FIG. 12B, shanks 61 of stayrods 6 passes through bores 60 in central fluid module 2. Alignment between central fluid module 2 and seat carriers 1 is maintained by the concentric fit between shanks 61 of stayrods 6 and bores 60 in central fluid module 2. Face 37 of packing box module 3 abuts face 47 of central fluid module 2 and face 16 of seat carrier 1 abuts face 46 of central fluid module 2. Face 67 of stayrod 6 abuts face 47 of central fluid module 2 and face 77 of hex nut 7 abuts face 17 of seat carrier 1. Torque applied to hex nut 7 forces central fluid module 2 and seat carrier 1 into binding contact creating a rigid modular housing 101. Similarly, shanks 81 of packing box module retaining bolts 8 pass through bores 80 of central fluid module 2 to bind and secure the packing box module 3 to central fluid module 2. Alignment of packing box module 3 to central fluid module 2 is achieved by concentric fit between bores 80 in central fluid module 2 with shanks 81 of packing box module retaining bolts 8.

Figure 12C:
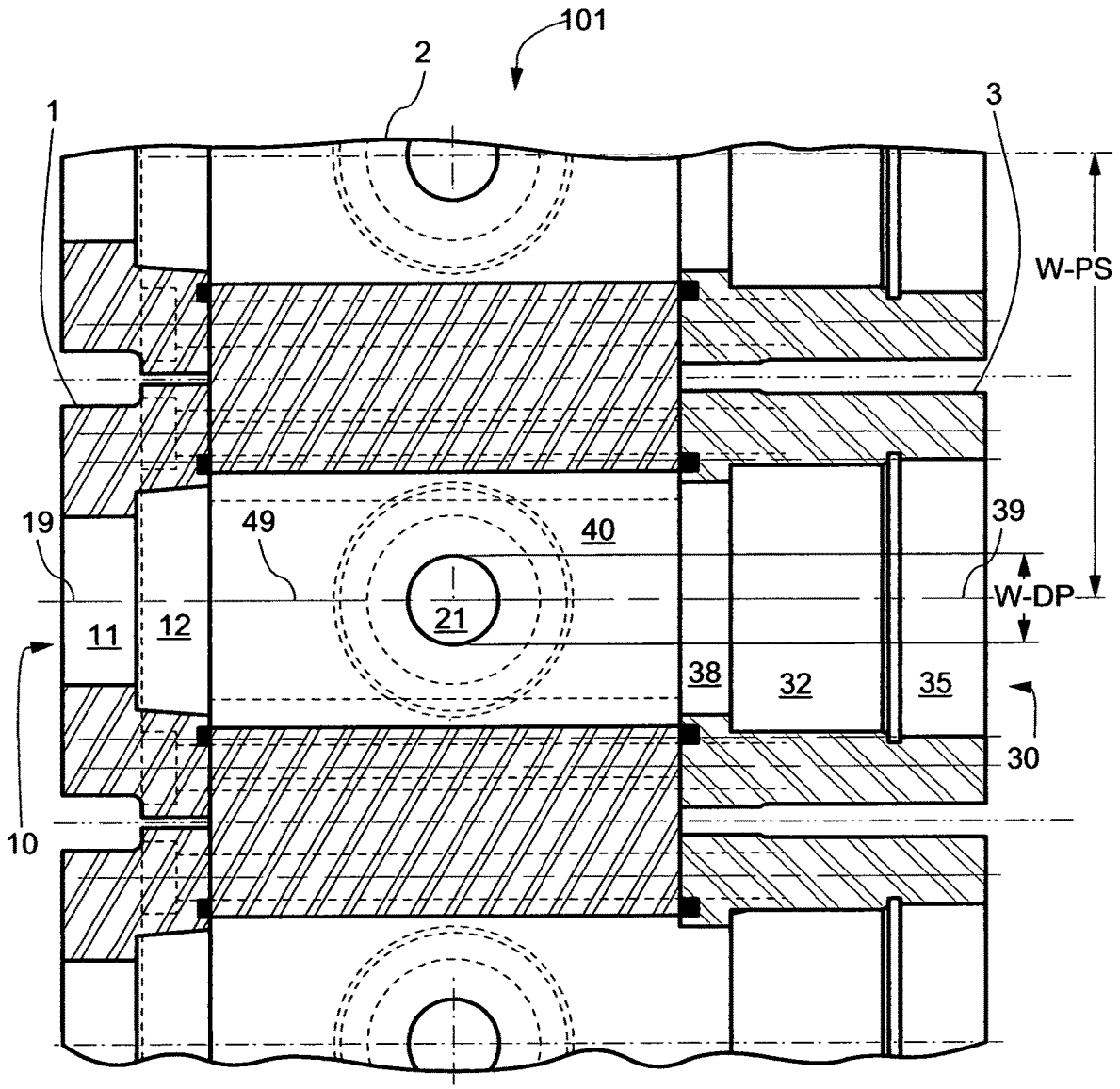
FIG. 12C schematically illustrates the sectional view labeled B-B in FIG. 12A.

FIG. 12B schematically illustrates Section "B-B" of FIG. 12A; FIG. 12C schematically illustrates Section "C-C" of FIG. 12A. FIG. 12B illustrates the relationship of width W-DP of the discharge port 21 to the width of the plunger spacing W-PS. In the present invention, the width W-DP is measured perpendicular to a plane formed by the centerlines 49 and 29 of the plunger bore 40 and discharge bore 20, respectively. The pressure within the plunger bore 40 and the discharge port 21 is cyclic due to the varying pressures of near zero pressure on the suction stroke of the plunger 410 and maximum pump pressure on the discharge stroke. As opposed to static loads, cyclic pressure loads result in fatigue that requires thicker wall thickness to prevent failure. For pumps with four (4) stayrods 6 per plunger, the wall thickness WT, between the stayrod bores 60 and the discharge port 21 is limited. To establish an adequate safety factor on a pump with four (4) stayrods 6 per plunger, the minimum wall thickness WT must be greater than 50% of the width W-DP of the discharge port 21 measured perpendicular to a plane defined by the plunger bore 40 centerline 49 and the discharge bore 20 centerline 29. Alternately this relationship is mathematically expressed as: WT≥50%-W-DP. Similarly the width of the discharge port W-DP is limited to approximately 20% of the plunger spacing W-PS. Alternately this relationship is mathematically expressed as: W-DP≤20% W-PS.

FIG. 12B also illustrates the relationship between the diameter D-SP of the suction port 11, the diameter D-DM of the discharge manifold 50, and the width W-DP of the discharge port 21. The width W-DP of the discharge port 21 is substantially half the diameter D-SP of the suction port 11. Alternately, this relationship is mathematically expressed as: W-DP~=50% D-SP. The width W-DP of the discharge port 21 is equal or less than the diameter D-DM of the discharge manifold 50. Alternately this relationship is mathematically expressed as: W-DP≤D-DM.

Figure 3A:
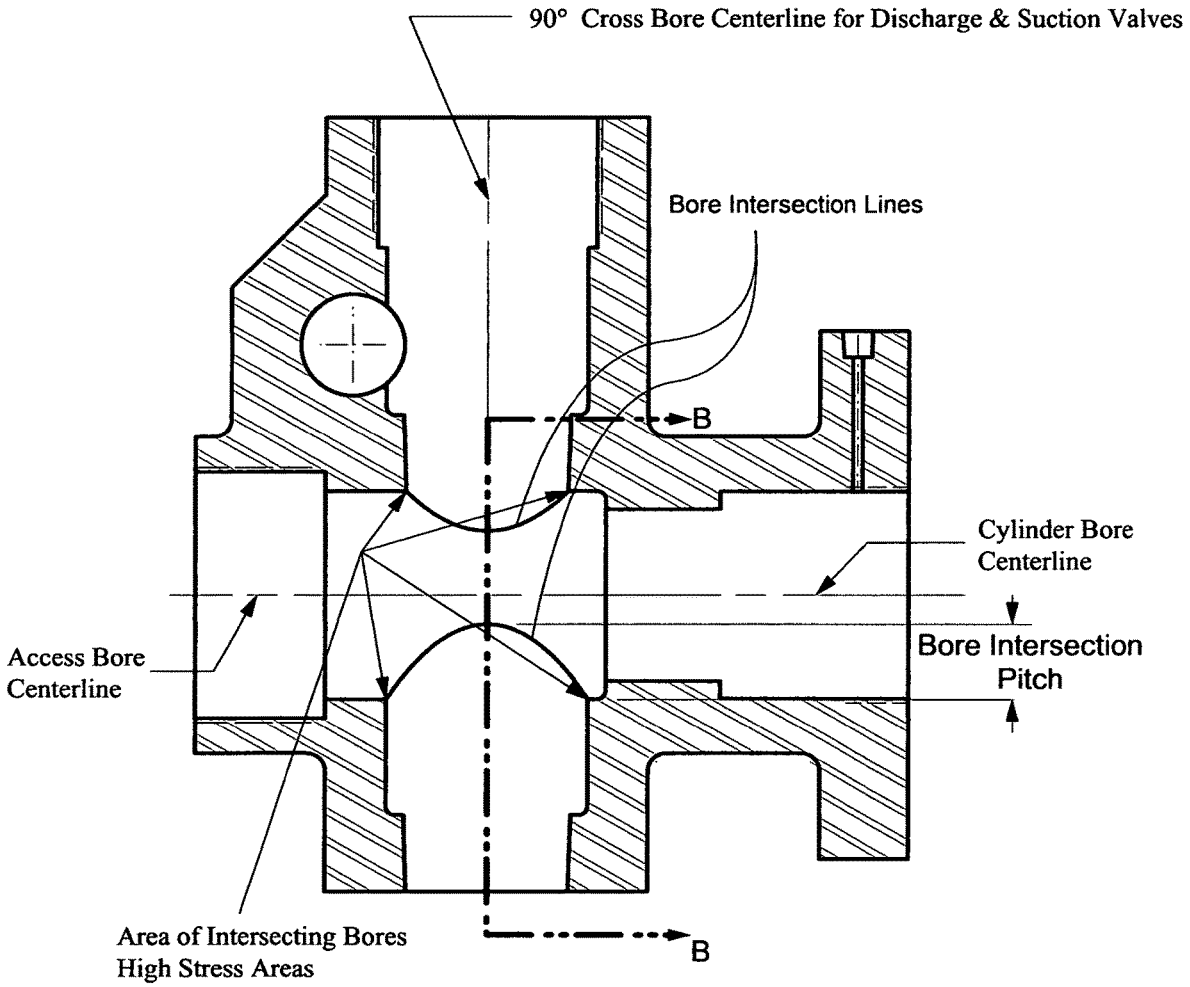
Prior Art Figure 3A
FIG. 3A is a cross-sectional schematic view of suction, plunger, access and discharge bores of a conventional prior art plunger pump housing intersecting at right angles and showing areas of elevated stress and the "Bore Intersection Pitch."
Figure 3B:
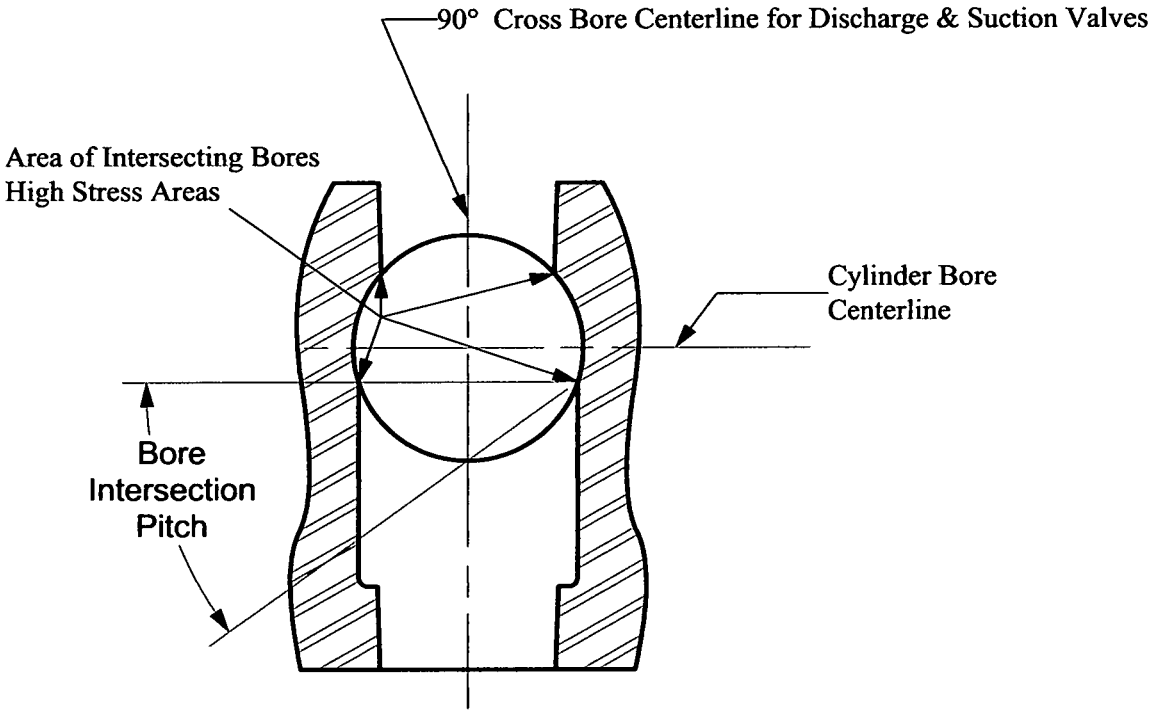
FIG. 3B schematically illustrates the sectional view labeled B-B in FIG. 3A.
Figure 4A:
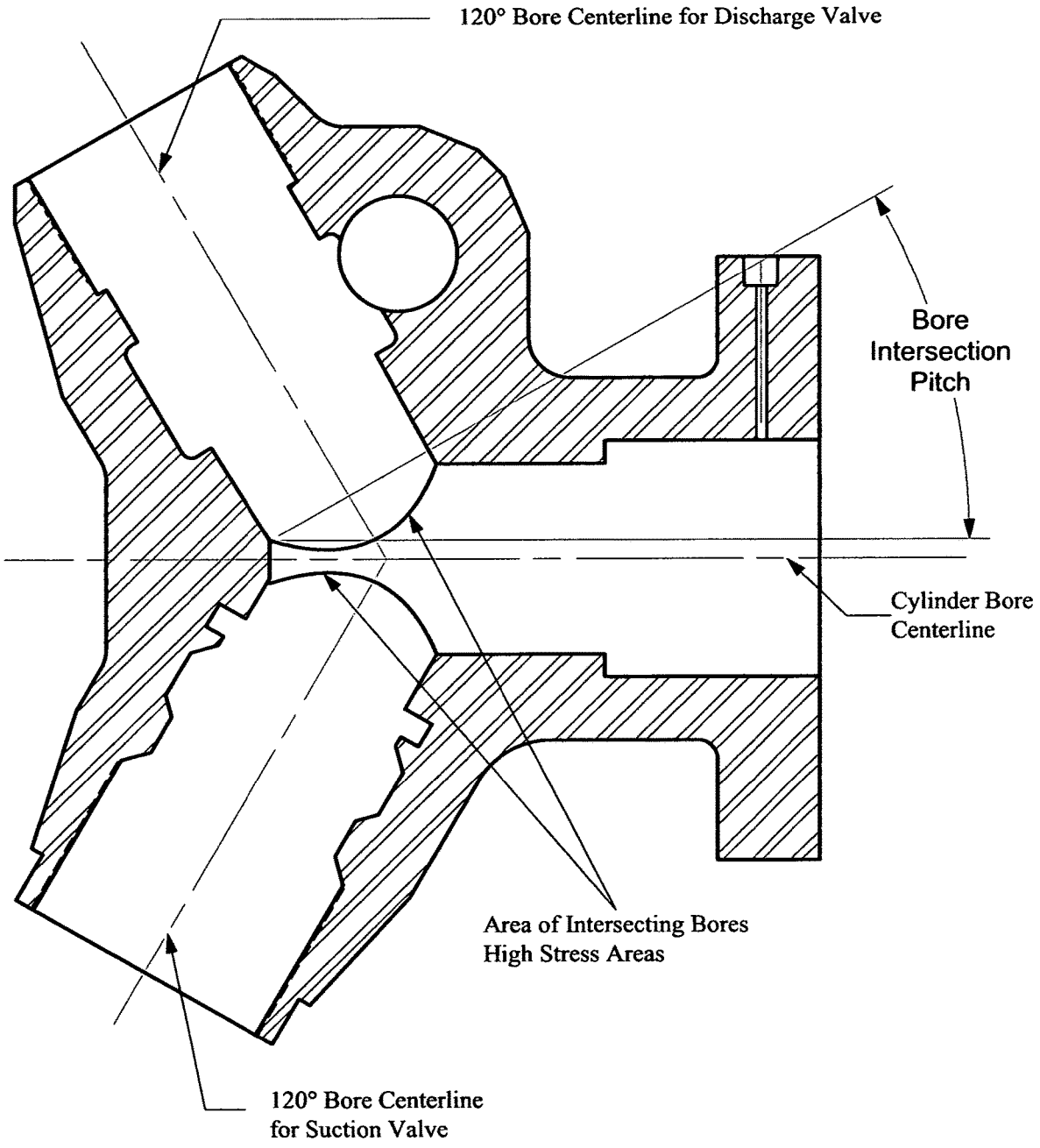
Prior Art Figure 4A
FIG. 4A is a cross-sectional schematic view of suction, plunger and discharge bores of a prior art Y-block plunger pump housing intersecting at obtuse angles showing areas of elevated stress and the "Bore Intersection Pitch."
Figure 4B:
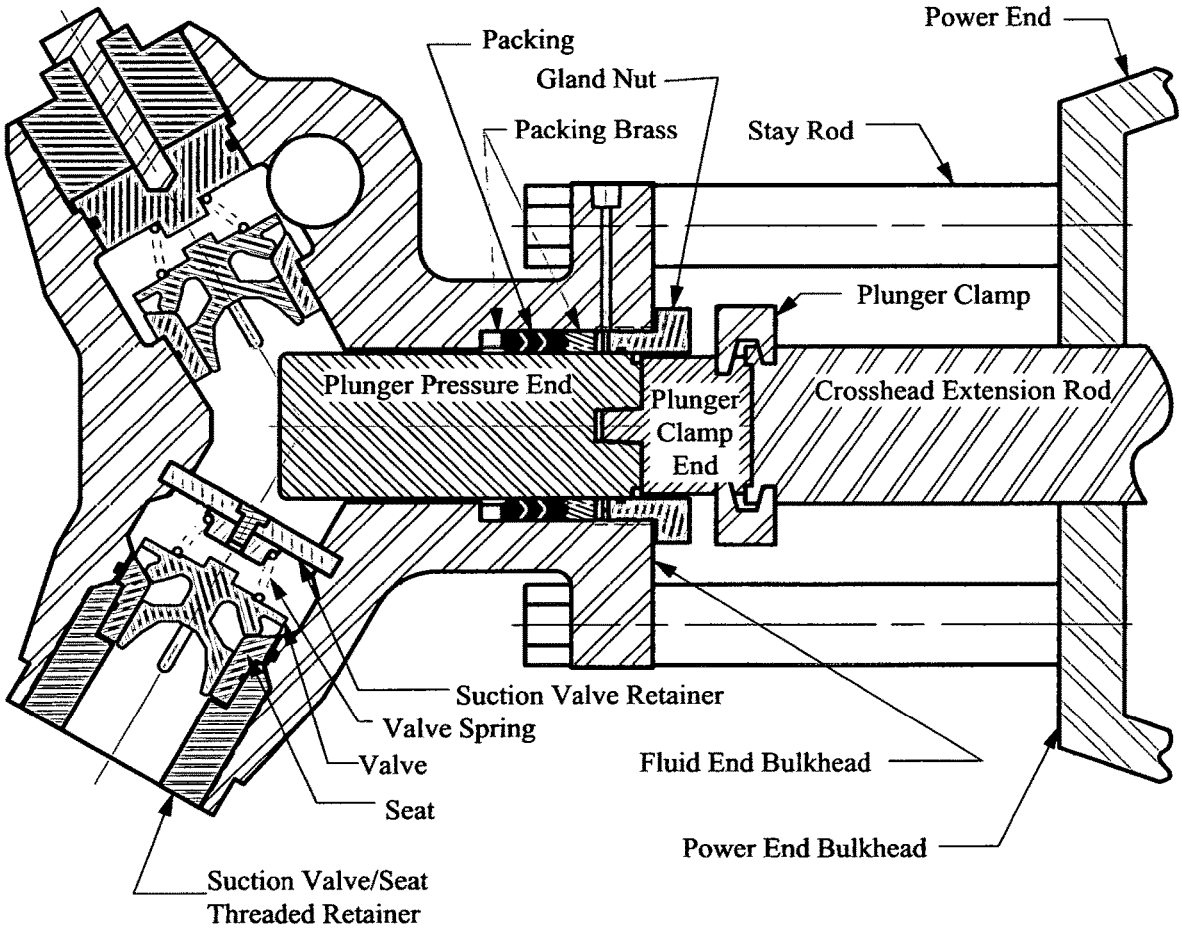
Prior Art Figure 4B
FIG. 4B is a cross-sectional schematic view similar to that in FIG. 4A, including internal plunger pump components of a prior art Y-block fluid end.
Figure 5:
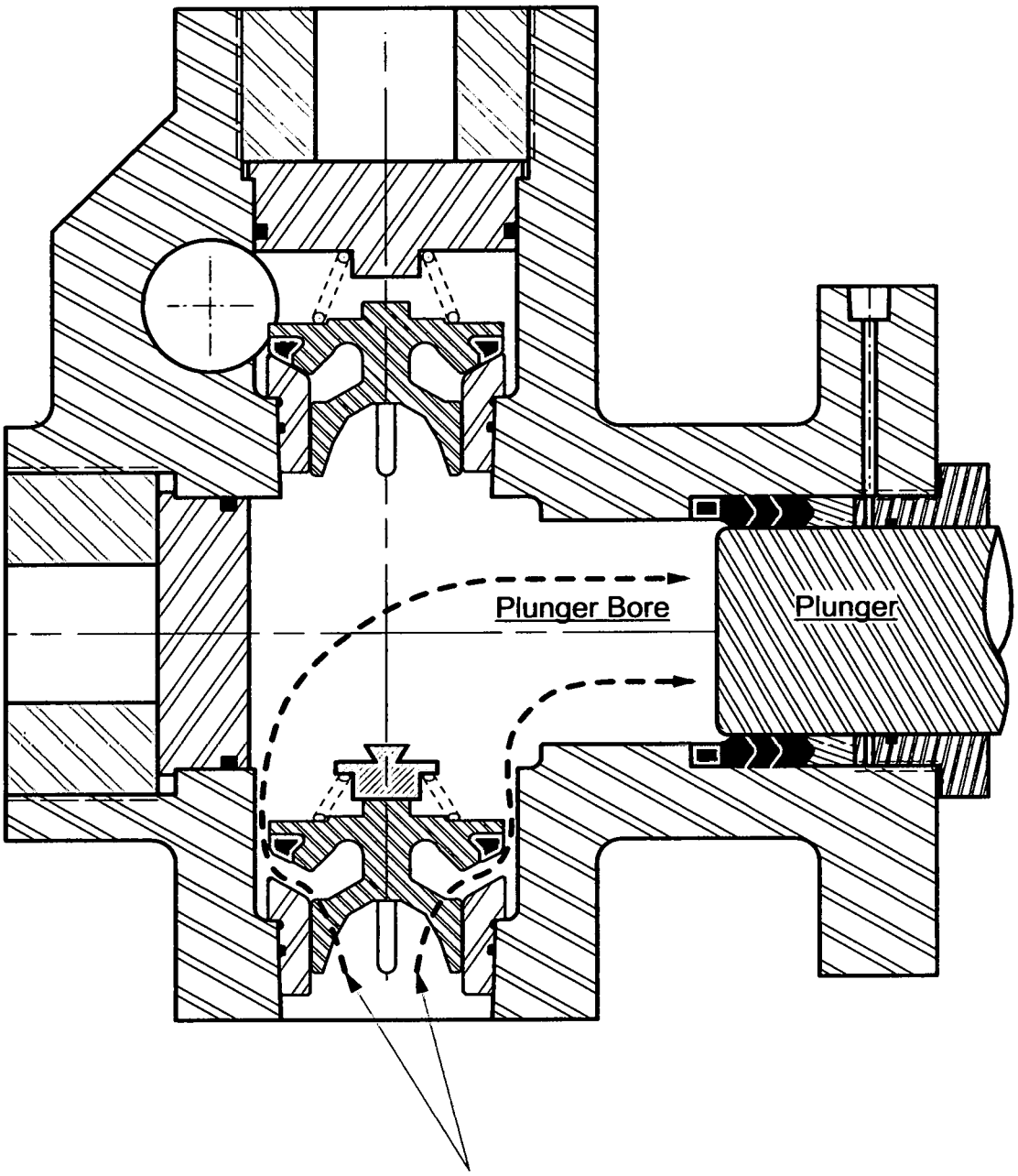
Prior Art Figure 5
FIG. 5 schematically illustrates a cross-section of a prior art right-angular plunger pump with valves, plunger, and a suction valve spring retainer showing the flow around the suction valve and the turn of the fluid into the plunger bore.
Figure 6A:
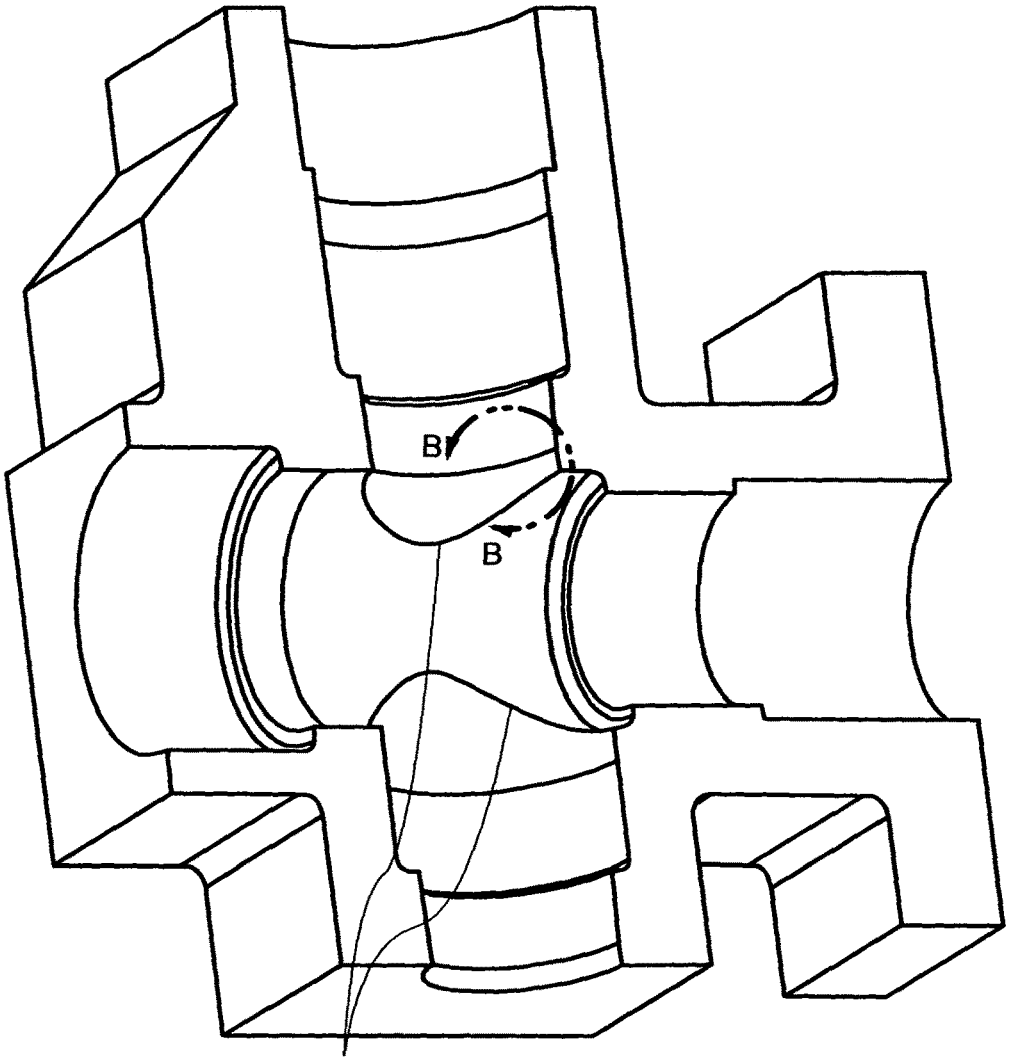
Prior Art Figure 6A
FIG. 6A schematically illustrates a three dimensional cross-section of one cylinder of a prior art right-angular plunger pump.
Figure 6B:
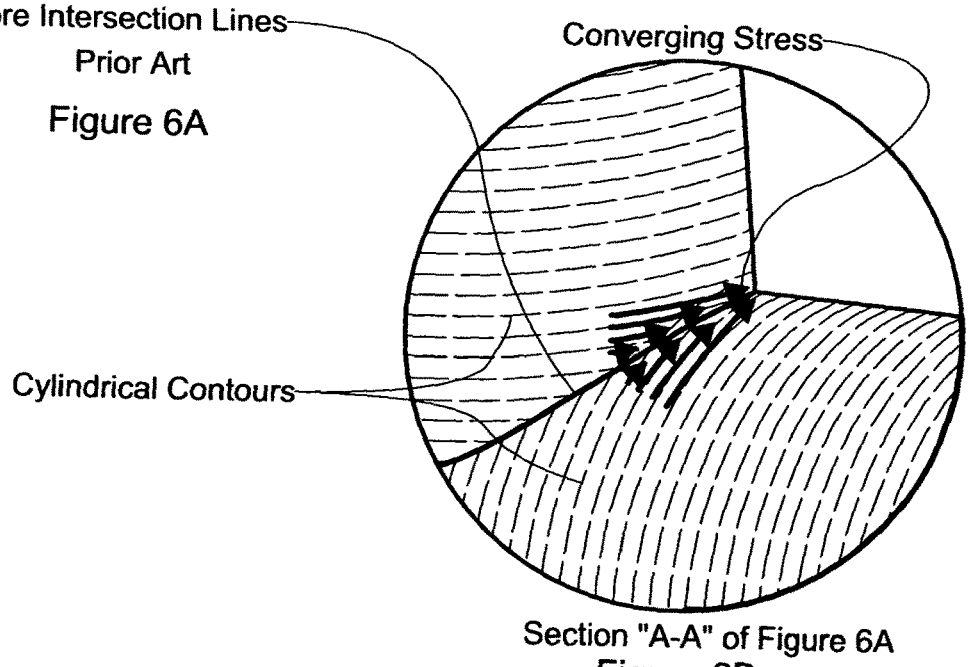
FIG. 6B schematically illustrates the enlarged sectional view labeled B-B in FIG. 6A highlighting the convergence of the stress at the intersection bores.
Figure 7:
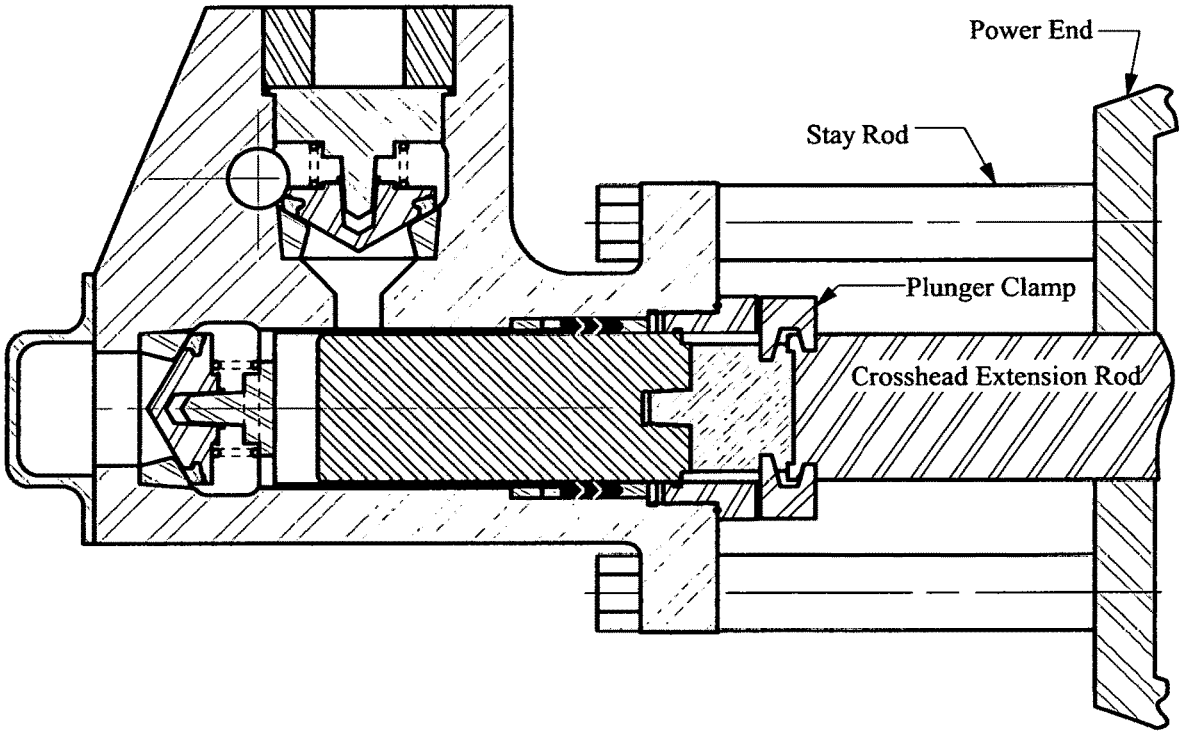
FIG. 7 schematically illustrates an inline fluid end of the prior art of U.S. application Ser. No. 15/330,213.

As shown in FIG. 10B, discharge port 21 connects with frusto-conical volume 23 to accommodate the flow through the valve seat 212 at the major diameter 25 at the top of the frusto-conical volume 23. The reduced diameter at the bottom of the discharge port 21 ensures that bore intersection 42 with plunger bore 40 occurs with a very low bore intersection pitch as opposed to the bore intersections of conventional fluid end housings as illustrated in FIGS. 3A, 3B, and 4A, which have slopes diverging significantly ("warped") in three-dimensional space. The greater the warpage of the bore intersection, the greater the Bore Intersection Pitch and the greater the concentration of stresses at the bore intersections of the plunger bore with the suction or discharge bores in fluid end housings of the prior art. The stresses at the intersecting plunger and discharge bores of the present invention are significantly reduced over the stresses at the intersecting bores of the prior art.

FIG. 12C also illustrates the relationship the relationship between the width W-DP of the discharge port 21 and the width of the plunger spacing W-PS from the view of section "C-C" as defined in FIG. 12A. To establish an adequate safety factor on a pump with four (4) stayrods 6 per plunger, the width W-DP of the discharge port 21 measured perpendicular to a plane defined by the plunger bore 40 centerline 49 and the discharge bore 20 centerline 29 is limited to approximately 20% of the plunger spacing W-PS. Alternately this relationship is mathematically expressed as:

W-DP≤20% W-PS.

Figure 13A:
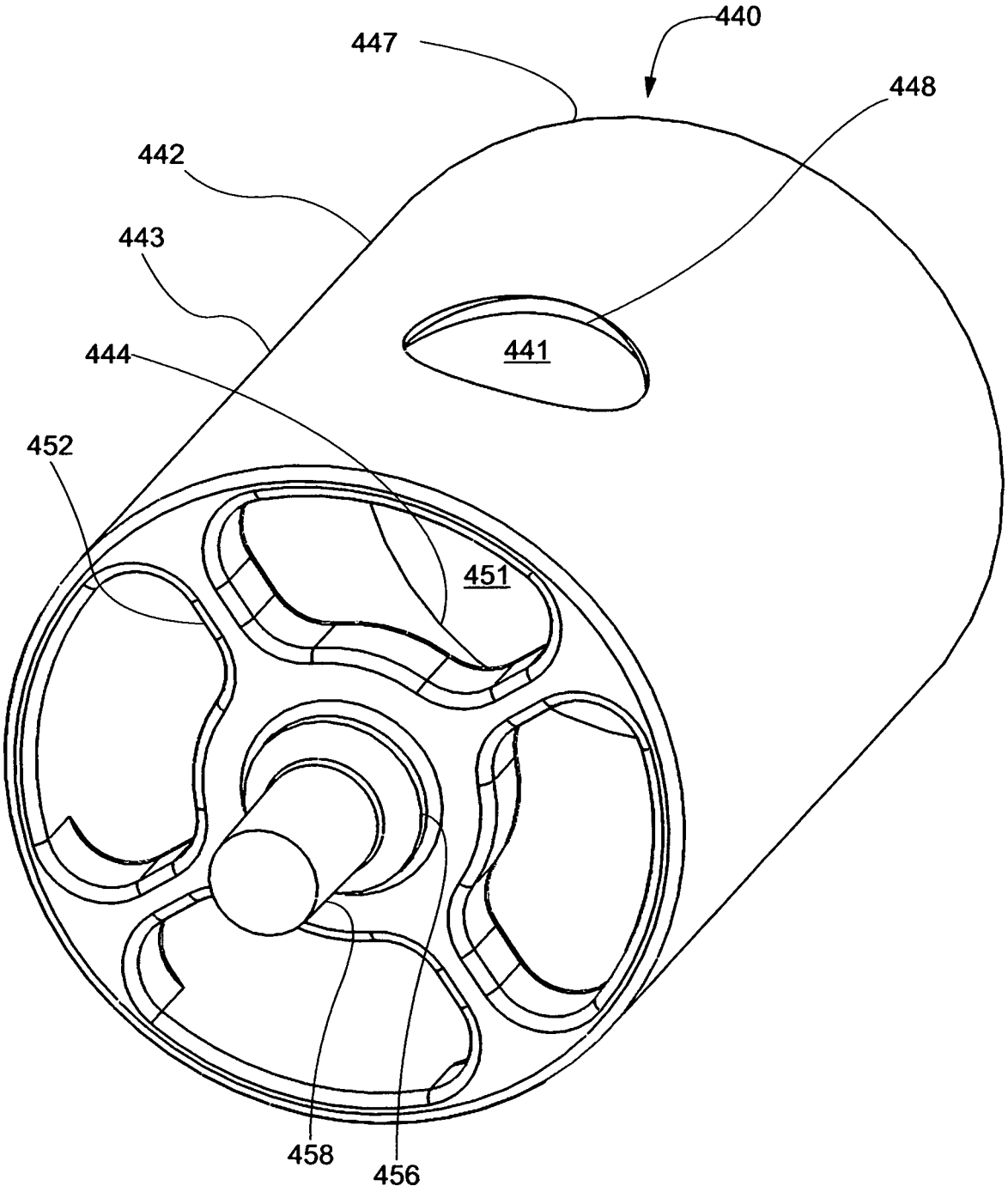
FIG. 13A schematically illustrates an orthogonal view of the suction valve spring retainer/plunger spacer of the fluid end assembly of this invention.
Figure 13B:
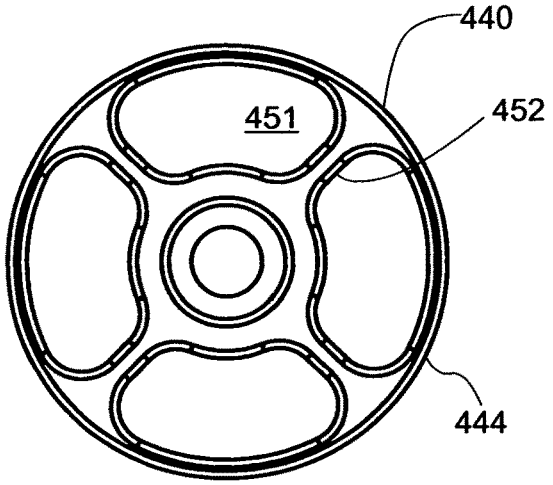
FIG. 13B schematically illustrates an end view of the suction valve spring retainer/plunger spacer of FIG. 13A.
Figure 13C:
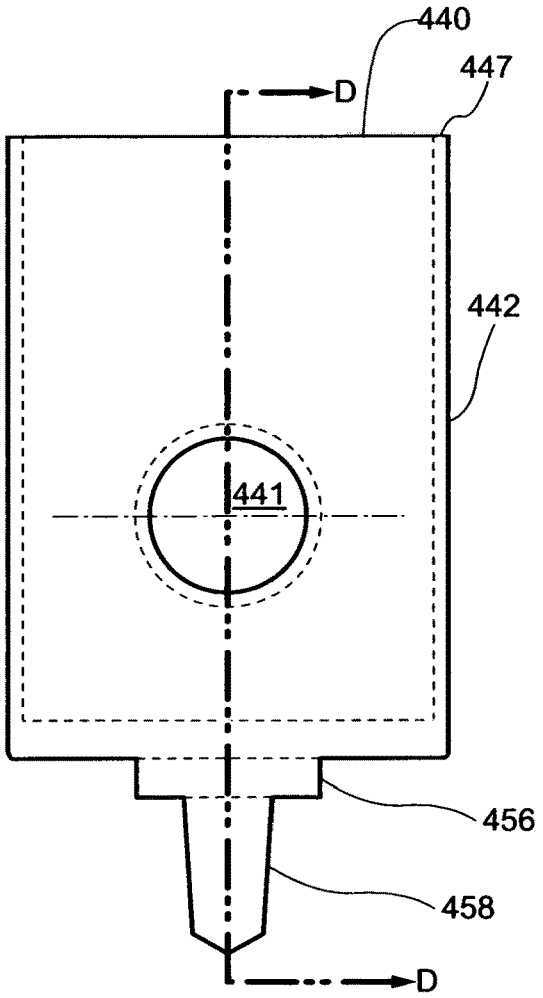
FIG. 13C schematically illustrates a top view of the suction valve spring retainer/plunger spacer of FIG. 13A.
Figure 13D:
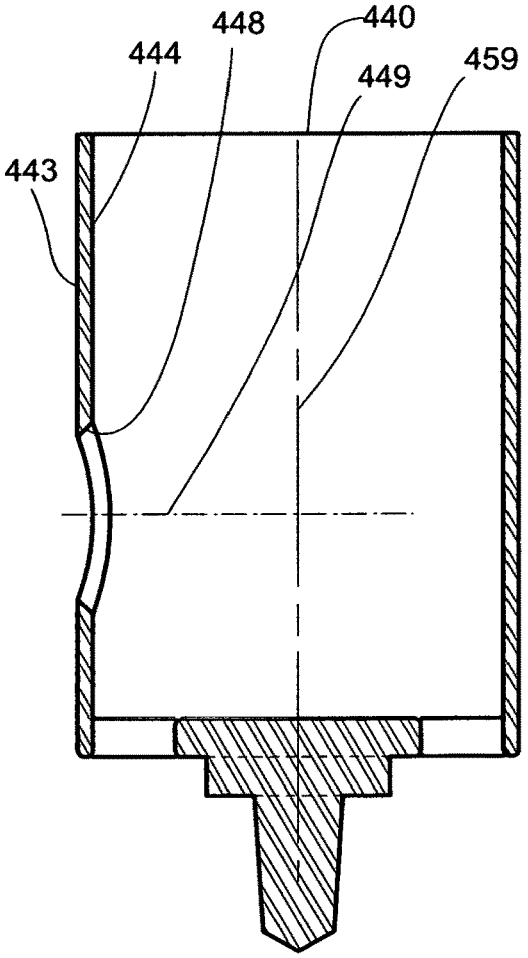
FIG. 13D schematically illustrates the sectional view labeled D-D in FIG. 13C.

FIGS. 13A, 13B, 13C and 13D schematically illustrate the suction valve spring retainer/plunger spacer 440. FIG. 13A illustrates orthogonal view of the suction valve spring retainer/plunger spacer 440. FIG. 13B schematically illustrates an end view of the suction valve spring retainer/plunger spacer 440. FIG. 13C schematically illustrates a top view of the suction valve spring retainer/plunger spacer 440. FIG. 13D schematically illustrates the section view labeled D-D of the suction valve spring retainer/plunger spacer 440 of FIG. 13C. Suction valve spring retainer/plunger spacer 440 is constructed with a sleeve shaped section 442, a suction valve spring retainer 456 and a suction valve guide 458. Sleeve section 442 is substantially tubular in shape with centerline 459.

Sleeve section 442 of suction valve spring retainer/plunger spacer 440 has a substantially cylindrically inside surface 444. The diameter of cylindrical inner surface 444 is slightly greater than diameter of plunger 410 to allow plunger 410 to reciprocate freely within sleeve section 442 of suction valve spring retainer/plunger spacer 440. Substantially cylindrical exterior surface 443 of sleeve section 442 of the suction valve spring retainer/plunger spacer 440 mates with plunger bore 40 of central section 2 of modular housing 101.

Sleeve section 442 has a port 441 that aligns with port 21 in central section 2 of modular housing 101. The spring retainer section 456 is configured to position and retain the suction valve spring 115. Spring retainer section 456 connects with sleeve section 442 via multiple webs 452. Multiple ports 451 allow passage of pumped fluid from the suction valve 114 to the interior of sleeve section 442 of the suction valve spring retainer/plunger spacer 440. Valve guide 458 guides suction valve 114 between the open and closed position against seat 112. Face 447, distal from valve guide 458, shoulders against face 37 of packing box module 3 of modular housing 101. Bevel 448 at the intersection of port 441 with inside cylindrical surface 444 reduces fluid turbulence as pumped fluid exits plunger bore 40 into discharge port 21. Centerline 449 of port 441 aligns with discharge bore 20 centerline 29 of central fluid module 2. The area of port 441 is equal or slightly smaller than the area of bore intersection 42 of port 21 in central fluid module 2.

Figure 14:
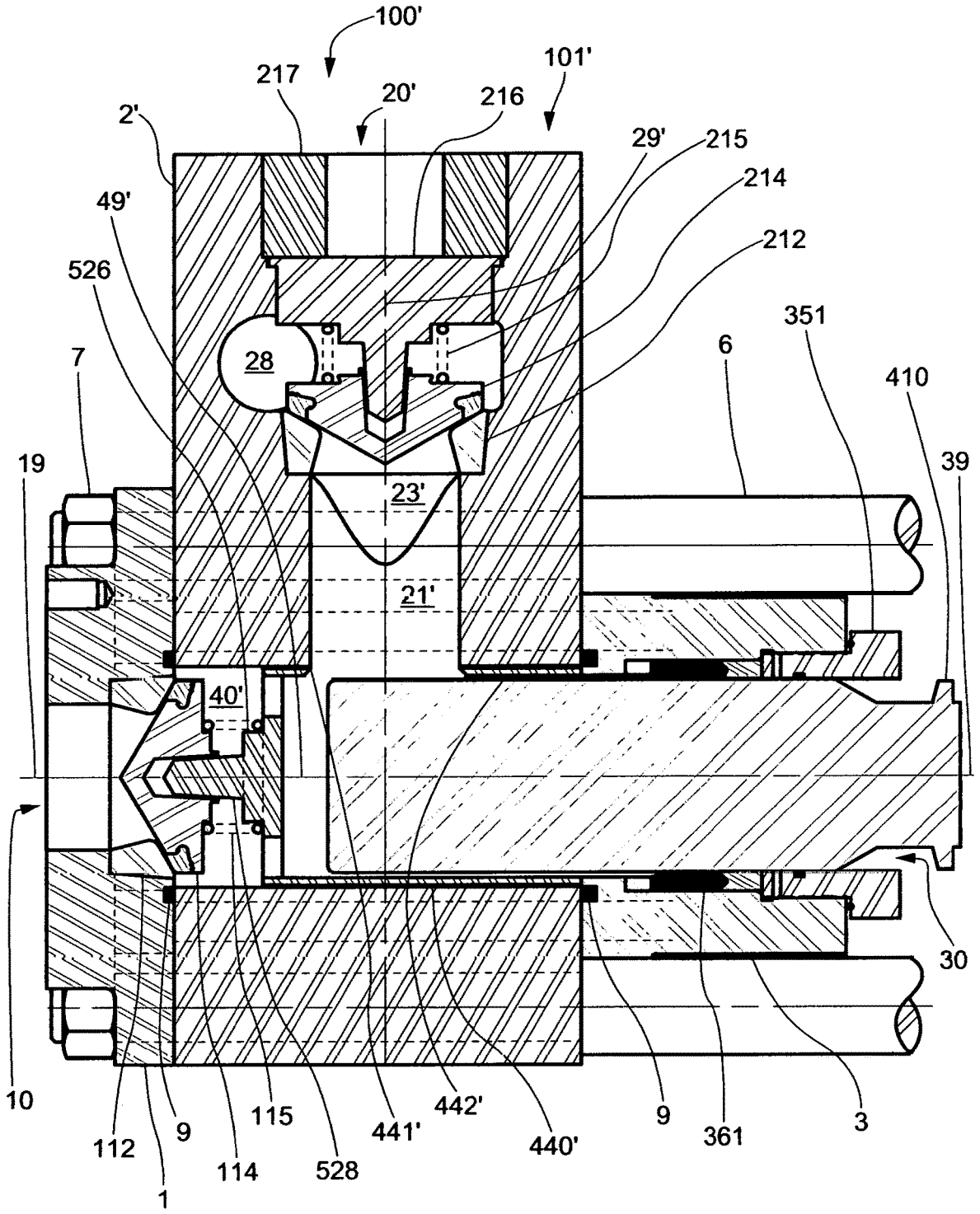
FIG. 14 schematically illustrates a cross-section of an alternate embodiment of the fluid end assembly of the present invention.

FIG. 14 schematically illustrates an alternate embodiment cross-section of the fluid end assembly 100' of the present invention showing modular housing 101' and the major internal components of the assembly 100' including a modular housing 101'. Compared to fluid end assembly 100 of FIGS. 8, 9, 10A and 10B the only difference in fluid end assembly 100' is the discharge port 21' and frusto-conical volume 23' of central fluid module 2' of fluid end housing 101'. In addition, there is a change to discharge port 441' of suction valve spring retainer/plunger spacer 440' of fluid end assembly 100'. No other components of fluid end assembly 100' are altered in design or function from the components of fluid end assembly 100.

Figure 15A:
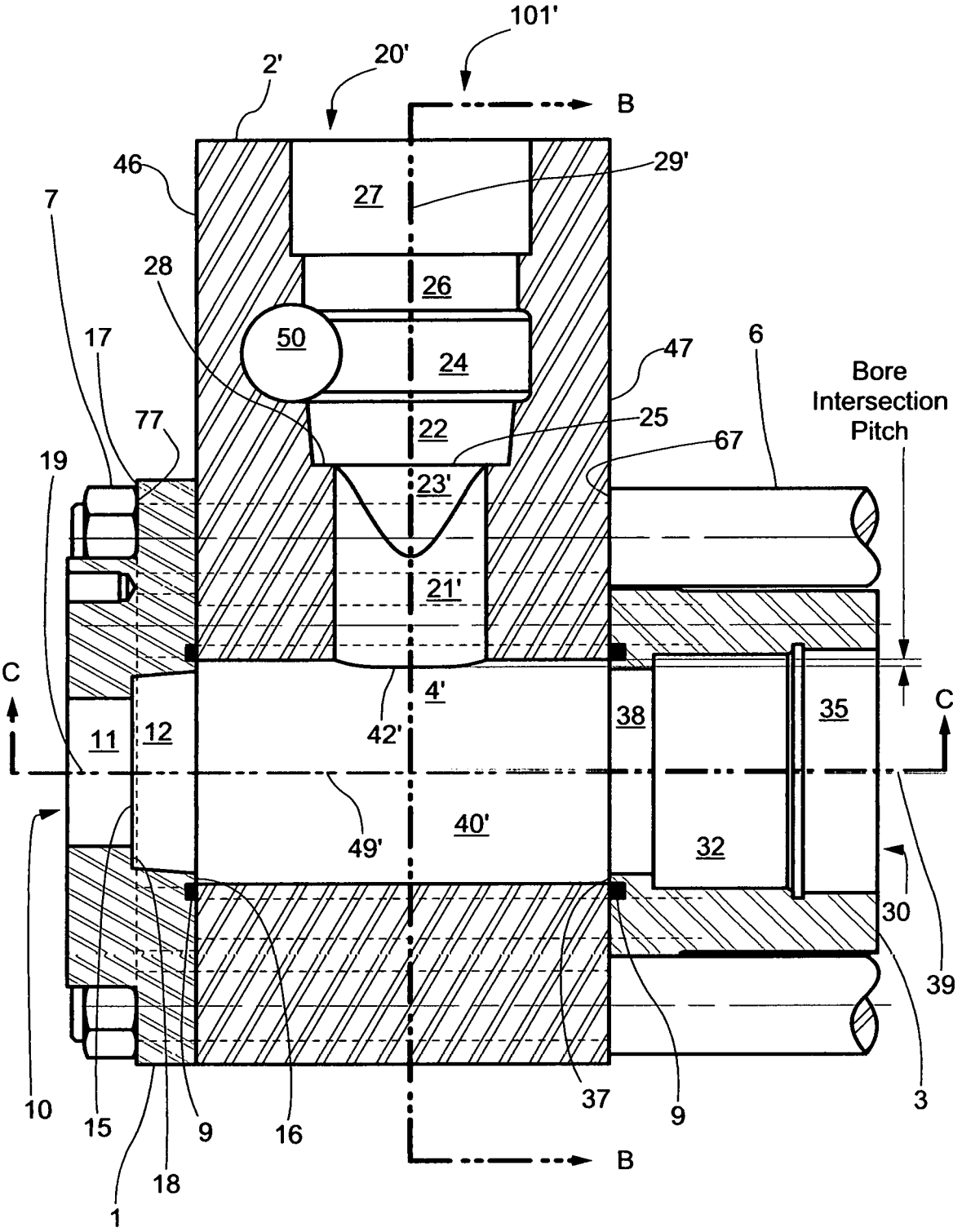
FIG. 15A schematically illustrates a cross-section of an alternate embodiment of the modular housing of the present invention.

FIG. 15A schematically illustrates a cross-section of an alternate embodiment of the central fluid module 2' of the modular housing 101' of the present invention. Central fluid module 2' features multiple fluid chambers 4', with one fluid chamber 4' for each plunger 400 in the pump. Each fluid chamber 4' consists of a discharge bore 20' and a plunger bore 40'. Central fluid module 2' differs only from central fluid module 2 of FIGS. 12A, B, and C in the design of the discharge port 21' that connects plunger bore 40' with the discharge bore 20' and the discharge valve and seat 214 and 212, respectively. All other areas of central fluid module 2' are identical with similar areas of central fluid module 2 as shown in FIGS. 12A, B, and C. In this embodiment, discharge port 21' is oblong in cross section, as shown in FIG. 15C, and connects with frusto-conical volume 23'. Volume 23' is identical to frusto-conical volume 23 of fluid end housing 2, except that the intersection of volumes 23' and 21' is altered from the intersection of volumes 23 and 21. In addition, intersection 42' that connects discharge port 21' with plunger bore 40' is elongated as shown in FIG. 15C as opposed to circular at the intersection of discharge port 21 plunger bore 40 of central fluid module 2.

Figure 15B:
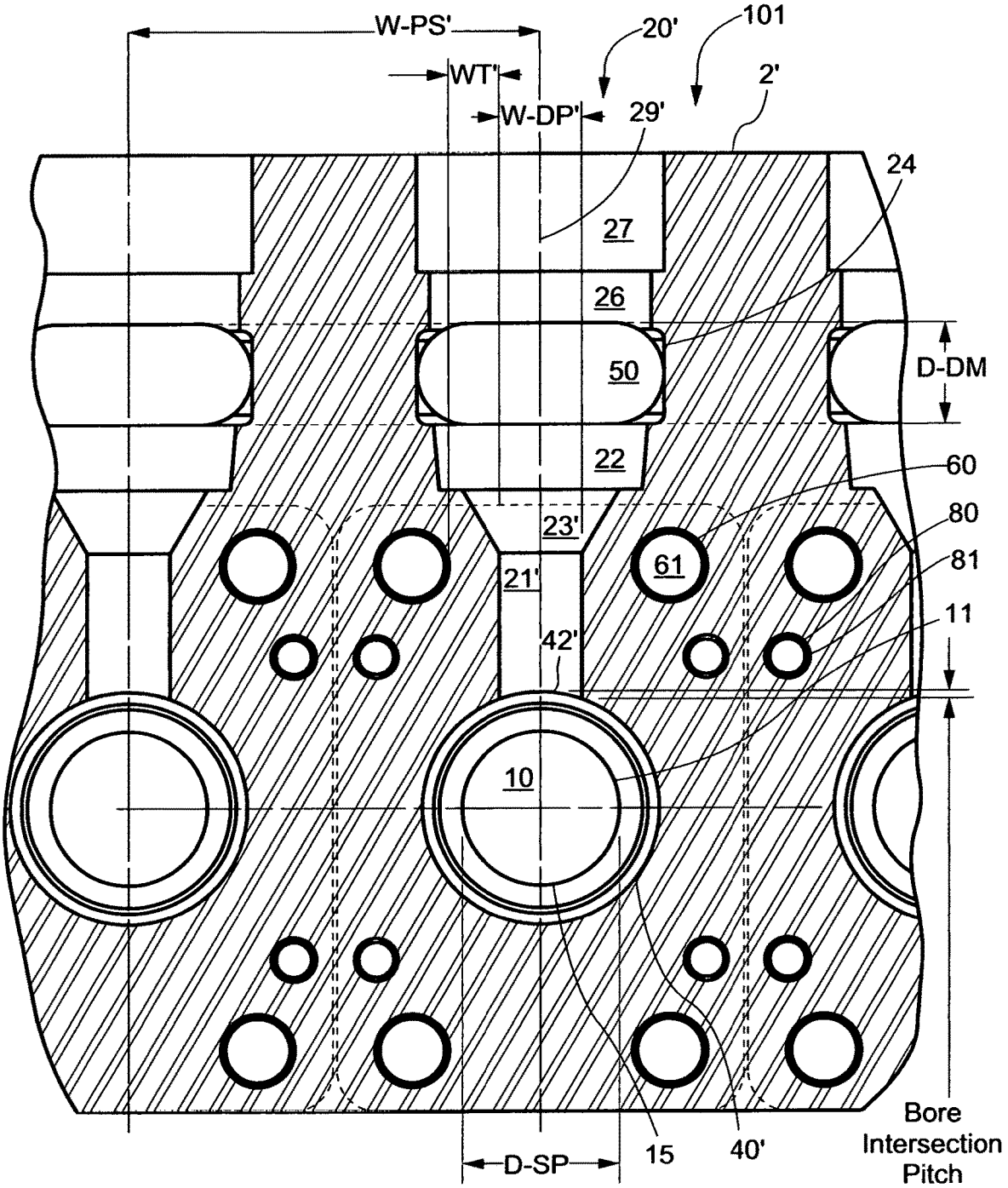
FIG. 15B schematically illustrates the sectional view labeled B-B in FIG. 15A.
Figure 15C:
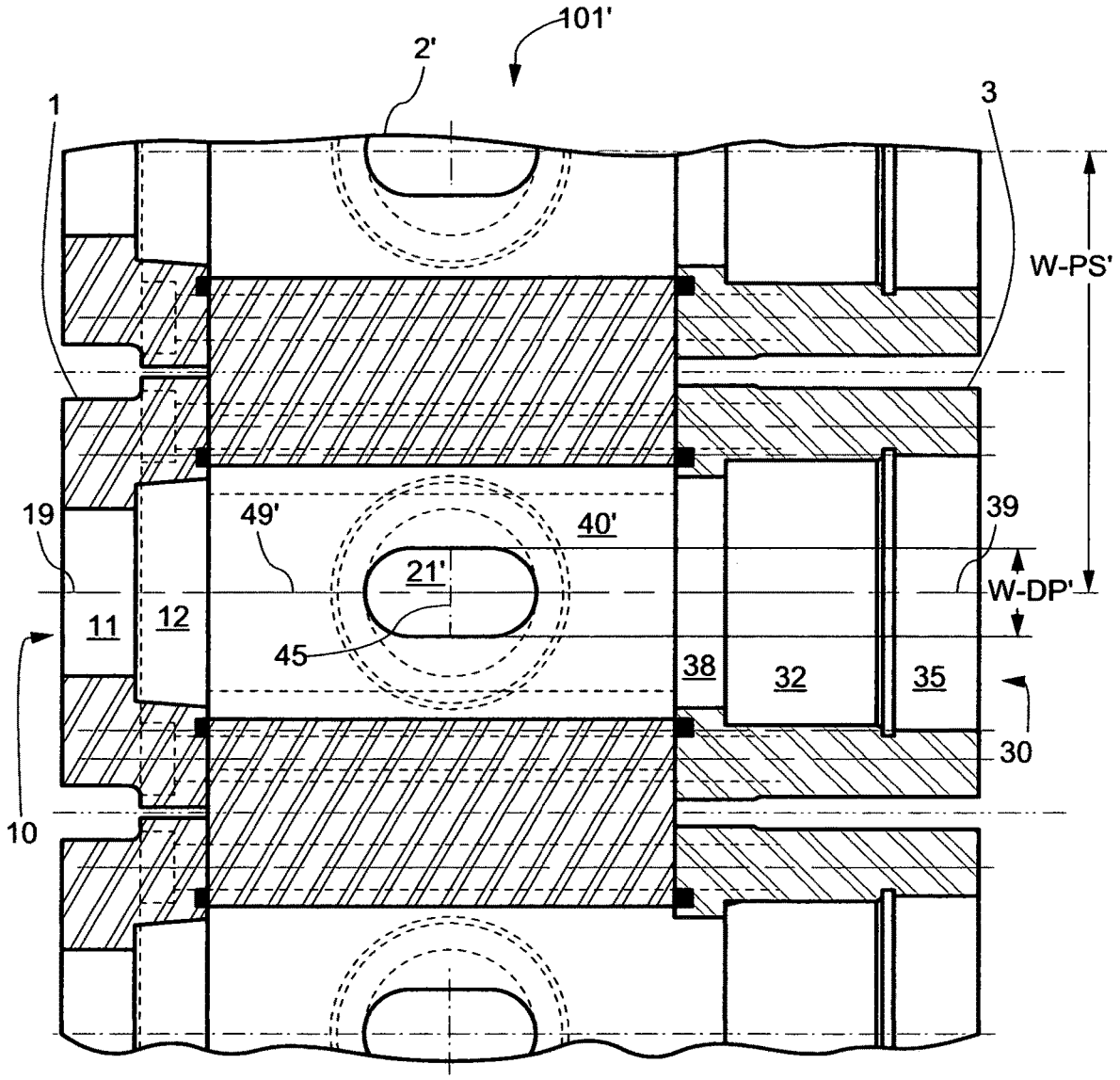
FIG. 15C schematically illustrates the sectional view labeled C-C in FIG. 15A.

FIG. 15B schematically illustrates Section "B-B" of FIG. 15A. FIG. 15C schematically illustrates Section "C-C" of FIG. 15A. FIG. 15B illustrates that the width W-DP' of the discharge port 21' is unchanged from width W-DP of discharge port 21 in FIG. 12B, unchanged despite the change in the shape of discharge port 21' and frusto-conical volume 23'. In this embodiment, this width is measured perpendicular to a plane formed by the centerlines 49' and 29' of the plunger bore 40' and discharge bore 20' respectively. Therefore, the minimum wall thickness WT' between the discharge port 21' and the stayrod bores 60 is also unchanged from FIG. 12B. The mathematical relationships, WT≥50% W-DP and W-DP'≤20% W-PS', are unchanged and the strength of this section of the central fluid module 2' is unchanged as compared to the strength of central fluid module 2. The major benefit of the alternate embodiment of FIGS. 15A, 15B, and 15C is that the flow area of the discharge port 21' is increased without effecting the strength of the central fluid module 2'.

Also illustrated in FIG. 15B is the unchanged relationship between the diameter D-SP of the suction port 11, the diameter D-DM of the discharge manifold 50, and the width W-DP' of the discharge port 21'. The width W-DP' of the discharge port 21' is approximately half the diameter D-SP of the suction port 11 and can be mathematically expressed as: W-DP'~=50% D-SP. The width W-DP' of the discharge port 21' is equal to or less than the diameter D-DM of the discharge manifold 50; mathematically expressed as: W-DP'≤D-DM.

FIG. 15C illustrates the oblong section of discharge port 21' where the short axis 45 of the oblong shaped discharge port 21' is perpendicular to a plane formed by the centerlines 49' and 29' of the plunger bore 40' and discharge bore 20' respectively. FIG. 15C also illustrates the unchanged relationship between the width W-DP' of the discharge port 21' to the width of the plunger spacing W-PS' from the view of section "C-C" as defined in FIG. 15A.

Figure 16A:
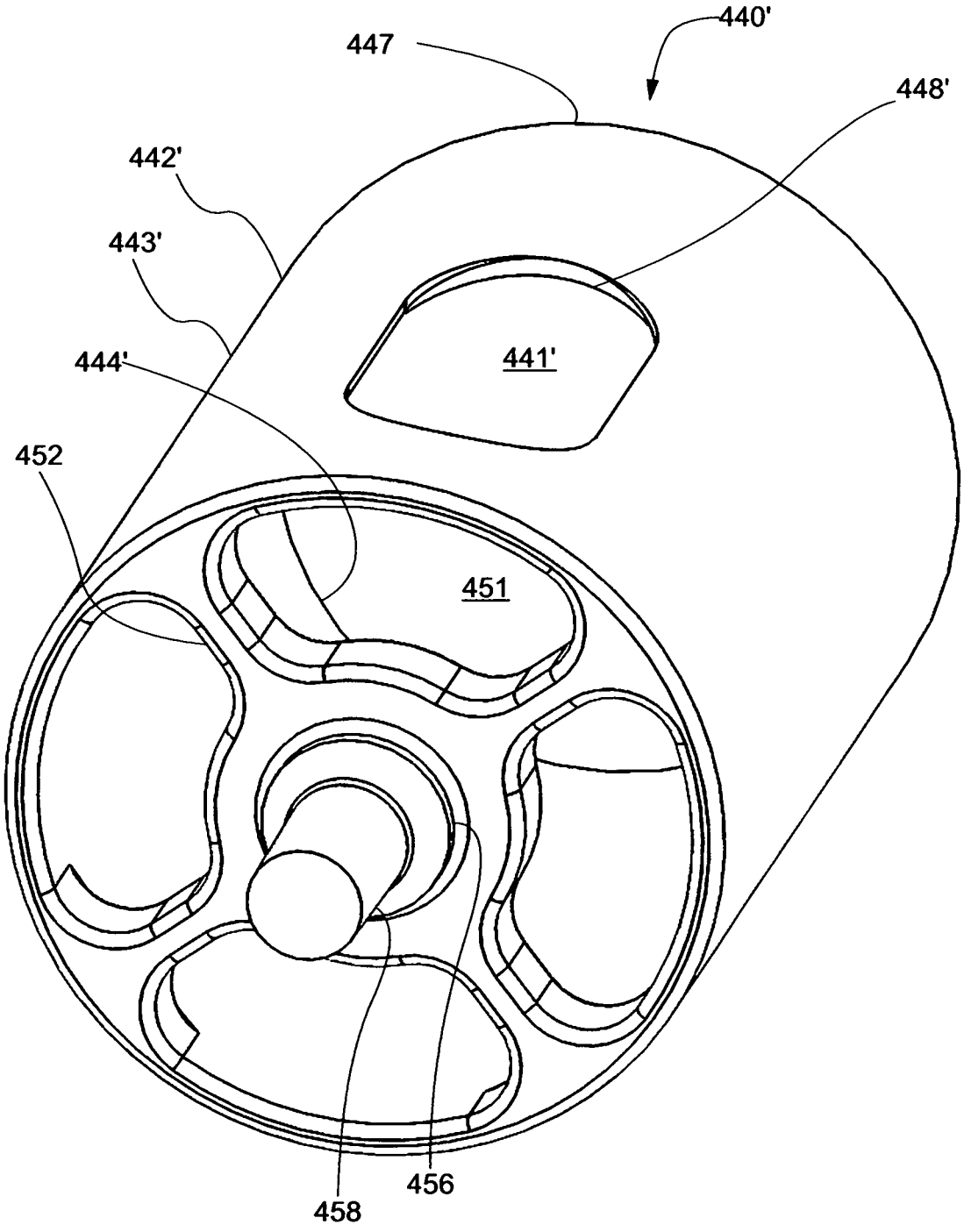
FIG. 16A schematically illustrates an orthogonal view of an of the suction valve spring retainer/plunger spacer of an alternate embodiment of the fluid end assembly of this invention.
Figure 16B:
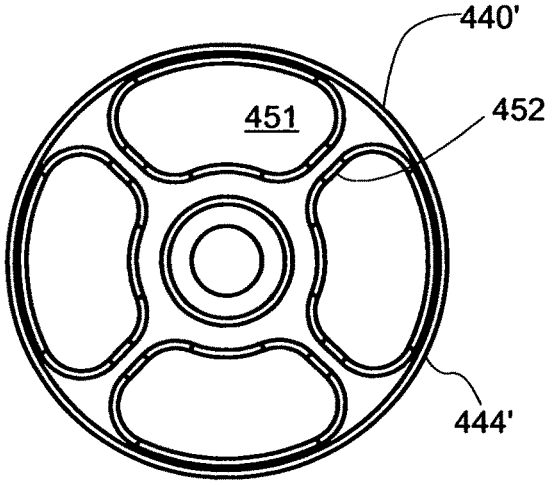
FIG. 16B schematically illustrates an end view of the suction valve spring retainer/plunger spacer of FIG. 16A.
Figure 16C:
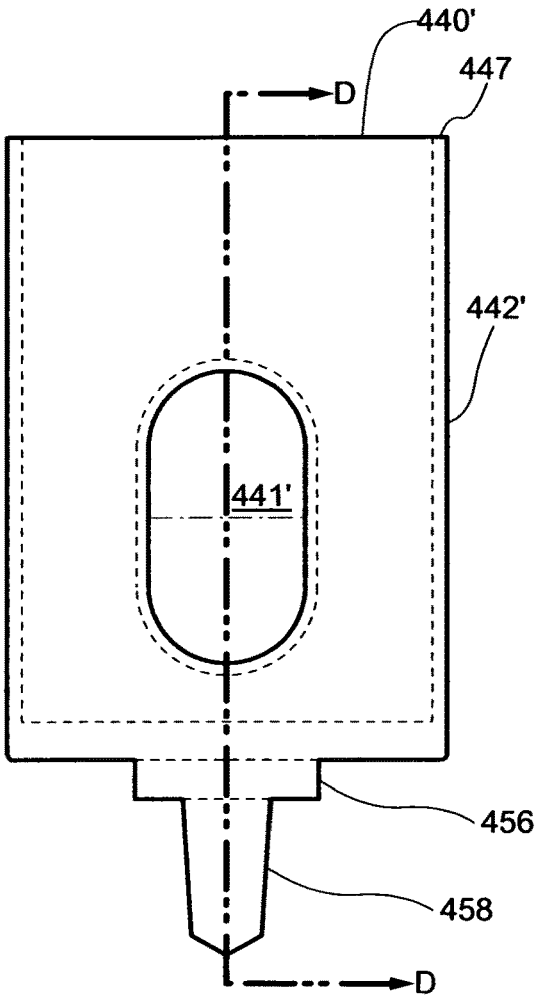
FIG. 16C schematically illustrates a top view of the suction valve spring retainer/plunger spacer of FIG. 16A.
Figure 16D:
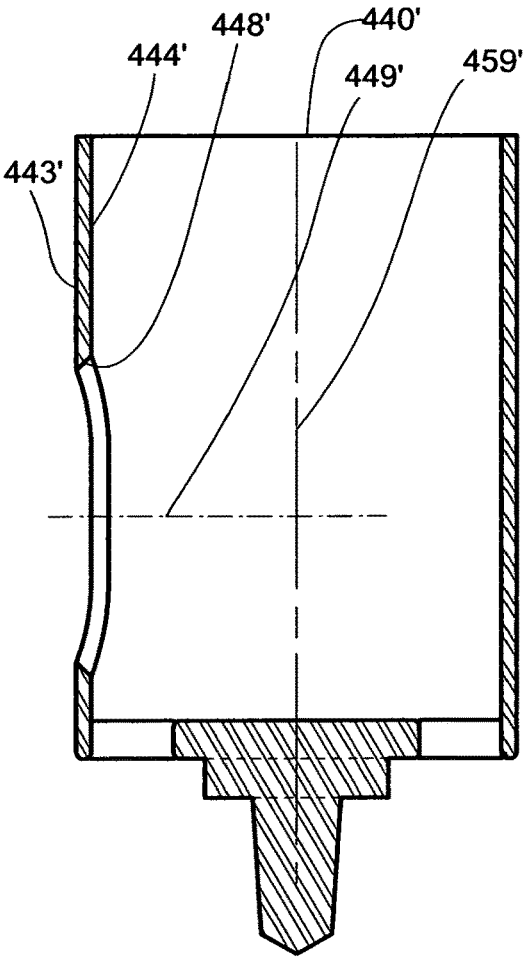
FIG. 16D schematically illustrates the sectional view labeled D-D in FIG. 16C.

FIGS. 16A, 16B, 16C, and 16D schematically illustrate the suction valve spring retainer/plunger spacer 440' a component of fluid end assembly 100'. FIG. 16A illustrates orthogonal view of the suction valve spring retainer/plunger spacer 440'. FIG. 16B schematically illustrates an end view of the suction valve spring retainer/plunger spacer 440'. FIG. 16C schematically illustrates a top view of the suction valve spring retainer/plunger spacer 440'. FIG. 16D schematically illustrates the section view labeled D-D of the suction valve spring retainer/plunger spacer 440' of FIG. 16C. Suction valve spring retainer/plunger spacer 440' is constructed with a sleeve shaped section 442', a suction valve spring retainer 456, and a suction valve guide 458. Sleeve section 442' is substantially tubular in shape with centerline 459'. The diameter of cylindrical inner surface 444' of sleeve section 442' is slightly greater than diameter of plunger 410 to allow plunger 410 to reciprocate freely within sleeve section 442' of the suction valve spring retainer/plunger spacer 440'. Substantially all of the cylindrical exterior surface 443' of sleeve section 442' of the suction valve spring retainer/plunger spacer 440' mates with plunger bore 40' of central section 2' of fluid end housing 101'.

Sleeve section 442' of suction valve spring retainer/plunger spacer 440' has a port 441' that aligns with port 21' in central section 2' of modular housing 101'. Centerline 449' of port 441' aligns with discharge bore 20' centerline 29' of central fluid module 2'. Valve guide 458, spring retainer section 456, face 447, multiple webs 452, and multiple ports 451 of suction valve spring retainer/plunger spacer 440' are unchanged from similar sections of suction valve spring retainer/plunger spacer 440 illustrated in FIGS. 13A, 13B, 13C, and 13D. Port 441' is substantially oblong in shape to coincide with oblong shape of discharge port 21' of central section 2'; long axis of oblong port 441' is parallel to centerline axis 459' of central section 442'. The area of port 441' is equal or slightly smaller than the area of bore intersection 42' of port 21 in central fluid module 2.

What is claimed is:

1. A plunger pump fluid end modular housing comprising:

a central fluid module;

a plurality of packing box modules;

a plurality of suction seat modules; and a plurality of plungers;

wherein the number of suction seat modules is equal to the number of plunger packing box modules and is also equal to the number of plungers;

wherein said central fluid module comprises a plurality of central fluid chambers and the number of said central fluid chambers equals the number of said plungers;

wherein each of said central fluid chambers comprises a plunger bore and a discharge bore;

wherein a centerline axes of a bore of each of said plurality of suction seat modules and a bore of a packing box module are colinear with a centerline axes of said plunger bore in each of said plurality of central fluid chambers;

wherein a centerline axis of the said discharge bore is perpendicular to the centerline axes of said suction seat and said plunger bore;

wherein the central fluid module is secured to a power end and said suction seat modules by stayrods that pass through stayrod bores in said central fluid module;

wherein said packing box modules are secured to said central fluid module by a plurality of packing box bolts and said packing block bolts pass through packing box bolt bores in said central fluid module; and wherein a discharge port of said discharge bore passes between two of each of said stayrod and packing box bolt bores without piercing either of said stayrod or packing box bolt bores.

2. A plunger pump fluid end modular housing of claim 1, wherein a width of said discharge port, measured perpendicular to a plane formed by the centerline axis of the plunger bore and the centerline axis of the discharge bore, is smaller in width than a port each of the plurality of suction seat modules.

3. A plunger pump fluid end modular housing of claim 1, wherein a width of said discharge port, measured perpendicular to a plane formed by the centerline axis of the plunger bore and the centerline axis of the discharge bore, is 50% or less of the width of a width of a port in each of the plurality of suction seat modules.

4. A plunger pump fluid end modular housing of claim 1, wherein a width of said discharge port, measured perpendicular to a plane formed by the centerline axis of the plunger bore and the centerline axis of the discharge bore, is less than a width of a discharge manifold in said central fluid module.

5. A plunger pump fluid end modular housing of claim 1, wherein a width of said discharge port, measured perpendicular to a plane formed by the centerline axis of the plunger bore and the centerline axis of the discharge bore, is less than 20% of a distance between the centerlines of adjacent said plunger bores.

6. A plunger pump fluid end modular housing of claim 1, wherein said discharge port is oblong in cross section at an intersection of the plunger bore and the discharge bore and a long axis of said oblong section is parallel with the centerline axis of said plunger bores.

7. A plunger pump fluid end modular housing of claim 1, wherein a minimum wall thickness between said discharge port and said stayrod bores is equal to or greater than 50% of a width of said discharge port, wherein said width is measured perpendicular to a plane formed by said centerline axis of the plunger bore and said centerline axis of the discharge bore.

* * * * *